US012084970B2

(12) United States Patent
Dineen

(10) Patent No.: US 12,084,970 B2
(45) Date of Patent: Sep. 10, 2024

(54) DIRECTIONAL DRILLING

(71) Applicant: Priority Drilling Ltd, Galway (IE)

(72) Inventor: Michael Dineen, Galway (IE)

(73) Assignee: Priority Drilling Ltd, Galway (IE)

( * ) Notice: Subject to any disclaimer, the term of this patent is extended or adjusted under 35 U.S.C. 154(b) by 0 days.

(21) Appl. No.: 18/355,593

(22) Filed: Jul. 20, 2023

(65) Prior Publication Data

US 2023/0358100 A1 Nov. 9, 2023

Related U.S. Application Data

(63) Continuation of application No. 16/753,526, filed as application No. PCT/EP2018/077367 on Oct. 8, 2018, now Pat. No. 11,788,358.

(30) Foreign Application Priority Data

Oct. 6, 2017 (GB) ..... 1716427

(51) Int. Cl.

| | |
|---|---|
| ***E21B 7/06*** | (2006.01) |
| ***E21B 23/04*** | (2006.01) |
| ***E21B 25/02*** | (2006.01) |
| ***E21B 47/024*** | (2006.01) |

(52) U.S. Cl.

CPC ..... *E21B 7/061* (2013.01); *E21B 7/067* (2013.01); *E21B 23/0411* (2020.05); *E21B 25/02* (2013.01); *E21B 47/024* (2013.01)

(58) Field of Classification Search

CPC ..... E21B 7/061; E21B 7/067; E21B 23/0411; E21B 25/02; E21B 47/024

See application file for complete search history.

(56) References Cited

U.S. PATENT DOCUMENTS

| | | | |
|---|---|---|---|
| 2,506,799 | A | 5/1950 | Livingston |
| 3,908,759 | A | 9/1975 | Cagle |
| 4,285,399 | A | 8/1981 | Holland et al. |

(Continued)

FOREIGN PATENT DOCUMENTS

WO 2019068938 A1 4/2019

OTHER PUBLICATIONS

Akakpo, Dany E.; Non-Final Rejection dated Jun. 23, 2021; U.S. Appl. No. 16/753,526; USPTO; Alexandria, Virginia.

(Continued)

*Primary Examiner* — Dany E Akakpo

(74) *Attorney, Agent, or Firm* — Stevens & Showalter LLP

(57) ABSTRACT

In preparation for directional drilling, a wedge supported distally ahead of a tubular drill string is advanced along a parent hole. The wedge is connected to the drill string by a rigid link that extends along a central longitudinal axis through an annular cutting head. The wedge may be connected to the drill string via an inner dropper mechanism that can be engaged by a wireline lifting system. After locking the wedge at a kick-off point in the hole at a desired azimuth, the connection of the link is broken. The dropper mechanism can then be retrieved and replaced by an inner core tube, without moving the drill string. The drill string is then advanced to drill a daughter hole that branches from the parent hole on the azimuth determined by the wedge. Advantageously, there is no need to withdraw the drill string before drilling the daughter hole can commence.

21 Claims, 13 Drawing Sheets

(56) References Cited

U.S. PATENT DOCUMENTS

| | | | | |
|---|---|---|---|---|
| 4,304,299 | A | 12/1981 | Holland et al. | |
| 5,551,509 | A | 9/1996 | Braddick | |
| 5,595,247 | A | 1/1997 | Braddick | |
| 5,647,436 | A | 7/1997 | Braddick | |
| 5,678,634 | A | 10/1997 | Rehbock et al. | |
| 5,709,265 | A * | 1/1998 | Haugen | E21B 7/061 166/55.6 |
| 5,826,651 | A | 10/1998 | Lee et al. | |
| 11,788,358 | B2 | 10/2023 | Dineen | |
| 2001/0025710 | A1 | 10/2001 | Ohmer | |
| 2003/0010533 | A1 | 1/2003 | Hart et al. | |
| 2011/0061865 | A1 | 3/2011 | Crawford | |
| 2013/0168151 | A1 * | 7/2013 | Grigor | E21B 23/04 175/81 |
| 2013/0319653 | A1 | 12/2013 | Ibragimov et al. | |
| 2015/0122495 | A1 | 5/2015 | Vincent et al. | |

OTHER PUBLICATIONS

Akapo, Dany E.; Final Rejection dated Dec. 15, 2021; U.S. Appl. No. 16/753,526; USPTO; Alexandria, Virginia.

Akapo, Dany E.; Advisory Action dated Feb. 25, 2022; U.S. Appl. No. 16/753,526; USPTO; Alexandria, Virginia.

Akapo, Dany E.; Non-Final Rejection dated Apr. 6, 2022; U.S. Appl. No. 16/753,526; USPTO; Alexandria, Virginia.

Akapo, Dany E.; Final Rejection dated Jan. 24, 2023; U.S. Appl. No. 16/753,526; USPTO; Alexandria, Virginia.

Akapo, Dany E.; Advisory Action dated May 1, 2023; U.S. Appl. No. 16/753,526; USPTO; Alexandria, Virginia.

Akapo, Dany E.; Notice of Allowance dated Jun. 12, 2023; U.S. Appl. No. 16/753,526; USPTO; Alexandria, Virginia.

* cited by examiner

DIRECTIONAL DRILLING

CROSS REFERENCE TO RELATED APPLICATIONS

This application is a continuation of U.S. patent application Ser. No. 16/753,526, filed Apr. 3, 2020, and entitled "DIRECTIONAL DRILLING", which is a National Stage Entry of PCT/EP2018/077367, filed Oct. 8, 2018, entitled "DIRECTIONAL DRILLING," the entire disclosures of which are hereby incorporated by reference herein.

FIELD OF THE INVENTION

This invention relates to directional drilling of boreholes. The invention relates especially to the challenges of creating a daughter hole that branches from a parent hole.

In principle, the invention could be used to drill holes for various purposes. However, this specification will describe the invention in the context of drilling holes to extract core samples from subterranean strata.

DESCRIPTION OF THE RELATED ART

Drilling is the most reliable and accurate way to conduct three-dimensional subterranean surveys. For example, exploration diamond drilling techniques may be used to explore and to delineate subterranean mineral resources such as lenses of ore.

During exploration drilling, core samples raised periodically from a hole are documented and stored for subsequent analysis. For example, core samples from multiple laterally-spaced holes may be used to construct geological sections. This establishes the continuity, extent and composition of a subterranean resource and so helps to define and quantify the available minerals.

Conventionally, a hole is drilled by a drilling rig located at the surface or underground, which assembles and rotates a drill string that extends into the hole. The drill string comprises multiple tubular drill rods that are joined end-to-end by threaded couplings.

The rig pushes the drill string while an annular cutting head comprising a diamond encrusted drill bit or drilling crown at the bottom of the rotating drill string cuts through the subterranean strata. The rig lifts up further drill rods to be added sequentially to the top of the drill string as the drill string is advanced into the deepening hole. A drilling fluid such as water is pumped along the drill string to cool the cutting head and to carry away drill cuttings.

The hole may be nominally vertical or may be inclined deliberately with respect to the vertical. The hole may even extend substantially horizontally or upwardly, at least in part. In any event, a typical hole will tend to curve slightly along its length as the path of the drill string is influenced by subterranean conditions and by gravity.

In the context of mineral exploration, it is common for a hole to extend beneath the surface to a subterranean target at a depth of 1 km to 2 km or more. Consequently, it can take several hours to assemble the full drill string and several hours more to disassemble the drill string if, for example, the cutting head requires replacement.

In use, the cutting head produces, and rotates around, a cylindrical core sample that extends into the hollow interior of the drill string. Successive core samples must be recovered to the surface after every few metres of drilling. To avoid the delay of disassembling the drill string while withdrawing it from the hole, it is necessary to recover the core sample to the surface while leaving the drill string in the hole.

This principle underlies 'wireline' drilling, in which the core sample is received in an inner core tube that lies concentrically within an outer drill rod at the bottom of the drill string. That lowermost drill rod defines an outer core barrel that carries the cutting head. Periodically, a wire extending down the hole from the surface is connected to the core tube so that the core tube, carrying the core sample, can be pulled up telescopically from within the surrounding outer core barrel.

Traditionally, delineation of subterranean mineral resources has been performed by pattern-drilling multiple holes from the surface. However, pattern drilling occupies a lot of land, raises access challenges, ties up valuable drilling equipment and costs a great deal of time and money. In view of these drawbacks, directional drilling techniques have been developed to allow a single primary 'mother' or 'parent' hole extending from the surface to branch underground into one or more secondary 'daughter' holes. Daughter holes may themselves branch into one or more tertiary 'granddaughter' holes which could each, in principle, branch into further generations of holes.

Thus, directional drilling allows a single hole at the surface to communicate with one or more branched holes underground. The branched holes provide additional intersections with a subterranean target, with a desired lateral spacing or spread of, say, 40 m between neighbouring holes. Compared with traditional pattern drilling from the surface, directional drilling requires less land and equipment and allows considerable savings in both time and money. Indeed, each daughter hole typically saves four to five weeks on conventional wireline drilling from the surface to a comparable depth.

For ease of reference, this specification will refer to an immediately preceding generation as a parent hole and the immediately succeeding generation branched from that hole as a daughter hole, whether or not another generation preceded the parent hole.

In one approach to mineral exploration, a vertical parent hole may be drilled through the entire host stratigraphy to establish the geological setting and the local structure. On completion, the parent hole is surveyed from the bottom to the surface. This determines the three-dimensional position and shape of the parent hole accurately and hence enables parameters to be calculated for subsequent daughter holes to be branched from it.

When the parent hole has been completed and surveyed and it is desired to create a daughter hole, the first requirement is to define a 'kick-off point' or KOP. The KOP is at the depth where the daughter hole is required to depart from the longitudinal axis of the parent hole. The KOP may, for example, be in an off-bottom location at a depth of, say, 900 m in a parent hole that is, say, 1500 m deep. For this purpose, a directional wedge is placed into the parent hole at the KOP to deflect a drill string laterally, out through a side of the parent hole, to initiate the daughter hole.

The wedge comprises an elongate, generally cylindrical wedge body that is dimensioned to fit closely within the parent hole at the KOP. The wedge body is cut away with shallow inclination relative to a central longitudinal axis to define an upwardly-tapering, concave wedge surface or wedge facet. A common example of such a wedge is known in the drilling industry as a 'Hall-Rowe' or 'whipstock'—type wedge.

The use of a directional wedge is well known in the art. Traditionally a wedge is connected to a milling head by a shear-pin arrangement; examples of such are described in U.S. Pat. Nos. 3,908,759; 5,647,436; US 20060037759; WO 02/02903; CN105649564; CN 205477483 and CN 205477484.

Other prior art examples of wedges for directional drilling are as follows: WO2017099780; CA 2475602; U.S. Pat. Nos. 2,445,100; 3,029,874; CN 202348244; CN202544778; U.S. Pat. No. 4,182,423; CN 203547610; CN 2753868; CN 2763455; EP 664372; U.S. Pat. No. 1,608,711; CN 205876188; U.S. Pat. No. 9,951,573; GB 2304760; GB 727897; CN202348191; US2003/010533; US 20130168151; DE 3832715; U.S. Pat. Nos. 6,003,621; 6,3608,21; 6,092,601; CN 202348191; US 20070240876; CN 204139966; US 20160326818; US20070221380; U.S. Pat. Nos. 9,617,791; 6,076,606; US 20020170713; U.S. Pat. Nos. 8,245,774; 5,871,046; 7,124,827; US20030196819; RU 2650163; SU 878894; SU 857416; US20030213599; U.S. Pat. Nos. 6,910,538; 6,427,777; WO 2011/150465; U.S. Pat. Nos. 6,899,173; 5,785,133 and CN 204960847.

Conventionally, placing a wedge in a parent hole is a complex and lengthy process requiring multiple 'trips' of a string of drill rods. In each trip, a rod string is assembled while being lowered to the KOP and is then disassembled while being raised from the KOP. For example, conventional wedge placement involves installing two plugs sequentially in the hole to support a subsequently-installed wedge. Each plug, followed by the wedge, must be installed in turn by being conveyed to the KOP by a rod string.

The first plug is a mechanically-expandable metal plug, for example as sold under the trade mark 'Van Ruth'. Such a plug may be run into the hole to the KOP attached to the bottom of a rod string or may be propelled by water pressure along a rod string to the KOP, where the plug emerges from the rod string and expands to engage with the surrounding wall of the hole. In either case, the rod string must be assembled to place the plug at the KOP and must then be disassembled.

The second plug is a cylindrical timber plug. This plug is run into the hole attached to the bottom of a rod string, to rest on top of the first plug installed previously. The second plug is a close sliding fit within the hole and is typically of softwood to absorb moisture and to expand in situ, hence to engage with the surrounding wall of the hole. Again, the rod string must be assembled to place the second plug atop the first plug and must then be disassembled.

The second plug is typically left in place at least overnight to expand and become fully set. Then, the wedge is assembled and run into the hole attached to the bottom of another rod string. When in the hole, the wedge is lowered to just above the timber plug and is oriented by turning the rod string to face the wedge facet toward a desired azimuth. Azimuth may be determined relative to magnetic north in substantially vertical holes, or relative to gravity in inclined holes.

Once the wedge facet has been oriented to a desired azimuth, the wedge is set securely in place by being engaged with the timber plug. Conventionally, this involves using the drilling rig to push down the rod string, which embeds a sharp blade edge at the bottom of the wedge with the timber plug. The wedge may also be cemented into the parent hole.

The wedge is now ready to deflect a drill string to initiate a daughter hole. The daughter hole will radiate downwardly and outwardly from the parent hole on approximately the desired azimuth determined by the orientation of the wedge facet. Of course, initiating the daughter hole involves yet another trip to disassemble the rod string and to reassemble the drill string.

Once the wedge has been set, conventional wireline coring may be used to drill a few metres past the wedge to establish the daughter hole. At this point, the magnetic influence of the wedge is eliminated and directional motor drilling equipment can therefore be oriented correctly in the daughter hole. Motor drilling ensures that the newly-established daughter hole has the required dip and azimuth before conventional wireline drilling resumes.

Thus, when the new daughter hole has been started by wireline drilling past the wedge, the drill string is pulled out of the hole. Directional motor drilling equipment is then assembled and run into the daughter hole attached to the bottom of a rod string. After every few metres of motor drilling, another orientation measurement is taken and if necessary, the orientation of the tool is corrected. When the daughter hole is on the correct trajectory with the required dip and azimuth, the motor drilling phase is completed and the rod string and motor drilling equipment are retrieved to the surface.

Reaming equipment may then be lowered on a rod string to ream the hole where it is most sharply curved near the KOP, which smooths and slightly enlarges the hole to help the rods of a wireline drill string to follow the bend. On completion of reaming, the rod string and the reaming equipment are retrieved to the surface and wireline drilling is resumed, coring the daughter hole to the subterranean target. Additional surveys may be done periodically to check the trajectory of the hole during this final wireline drilling phase to ensure that the target is reached and that no remedial directional drilling is required.

On completion of the daughter hole, a multi-shot survey is run from the bottom up to above the wedge to give an accurate position and to facilitate the calculations for any subsequent daughter or granddaughter holes.

Each trip involving assembly followed by disassembly of a rod string or drill string may take up an entire working shift, occupying two or more operators who work on the rig at the surface. It will be apparent that the duration and hence the related cost of these repetitive trips is a significant drawback.

Multiple trips also increase the risk that something could go wrong while lowering or raising a rod string or drill string, such as the wall of the hole collapsing inwardly or debris accumulating above the plugs. It is even possible that drill rods could be dropped outside or inside the hole, potentially injuring operators and severely disrupting drilling operations.

Another problem of conventional wedge placement is that engagement between the timber plug and the blade edge at the bottom of the wedge may be unreliable, particularly if debris arising from multiple trips accumulates above the plug. This could allow the wedge facet to turn away from a desired azimuth.

The use of both hydraulic and mechanical locking is well known in the art. Examples of hydraulic locking mechanisms are described in: U.S. Pat. Nos. 9,347,268; 7,789,134; RU2472913; RU2473768; RU 2469172; CA2446947; U.S. Pat. Nos. 5,163,522; 8,919,431; 7,448,446 and DE 4395361. Examples of mechanical locking mechanisms are described in GB 2309721; U.S. Pat. No. 5,829,531; AU 66732786 and US 10006264. US2006/0207771 and U.S. Pat. No. 7,963, 341 describe anchors capable of being activated mechanically or hydraulically.

Traditionally a 'bullnose' design facilitates the circulation of fluid to the anchor mechanism through a narrow channel within the cutting head. Examples of such are described in: ZA199008719; RU 107820U1; US 2013/0319653 and ZA 198900656.

The use of a pivot to further facilitate the alignment of the wedge mechanism is also described in the art. Examples of pivot mechanisms are described in: U.S. Pat. Nos. 4,303,299; 4,285,399; US2002/144815; U.S. Pat. No. 2,506,799; WO 95/07404; U.S. Pat. Nos. 6,167,961; 6,035,939; 1,570,518 and GB 2315506. Examples of alignment shoes in the prior art include: WO 99/49178; US 2013299160 and US 2007/0175629.

Additionally, the use of sensors for determining the orientation of a wedge is also described in the prior art. Examples of such are: WO 2014078028; WO 85/01983 and U.S. Pat. No. 5,488,989. Similarly the use of reference points is a known method for determining the orientation of a wedge. Examples of such are WO 2016/024867 and U.S. Pat. No. 6,427,777. Surveying tools that use Magnetic North as a reference have also been described in U.S. Pat. No. 5,467,819 and WO 95/23274.

In an effort to reduce the number of trips required to set a wedge, Groupe Fordia Inc. has developed what it calls a 'one-trip' wedge. As its name suggests, the wedge can be set with only one return trip of a rod string. However, 'one-trip' is a misnomer because the rod string has to be withdrawn and replaced by a drill string, hence requiring at least one more trip before drilling past the wedge to initiate a daughter hole can begin. Other examples of one-trip wedges include: WO 1995/023273; US 2015/122495 and GB 22480679.

Fordia's one-trip wedge employs a two-stage locking device beneath a wedge body. The first stage locks the wedge body at a desired depth in the parent hole. The second stage locks the wedge facet of the wedge body in the direction or azimuth required for the daughter hole.

The wedge is hung in the parent hole from a rod string via a wedge dropper. Once at the desired depth, the rod string is turned repeatedly to turn the wedge dropper and the wedge within the hole. This rotation relative to the surrounding wall of the hole causes a thread mechanism of the locking device to drive apart anchor arms, which splay against the wall of the hole to effect first-stage locking. Further rotation of the rod string shears a soft copper pin between the wedge body and the locking device, which frees the wedge body to turn relative to the now-stationary locking device. This allows the wedge facet to be oriented by turning the rod string further.

When the wedge facet has been oriented correctly, the rod string is pushed down to force together axially-engaging parts of the locking device, which locks the wedge facet in the required orientation. Continuing to push down the rod string shears soft copper rivets that fix the wedge body to the wedge dropper. This frees the wedge dropper to be lifted back to the surface on the bottom end of the rod string.

Whilst its operation is simple in theory, Fordia's one-trip wedge may be unreliable in practice. Multiple exposed cooperating parts have to work correctly even in difficult down-hole conditions. Also, the system places considerable reliance upon operators at the surface to perform each of the two locking stages fully and correctly. Yet, there is inadequate feedback to the operators to verify the progress and successful completion of each stage.

There is also a risk of premature or incomplete operation of the locking device on which Fordia's one-trip wedge relies. For example, the locking device could, apparently, be fixed adequately against rotational movement within the parent hole but, in reality, it could be fixed inadequately against longitudinal movement along the hole. If so, the wedge could slip down the hole to a level beneath the desired KOP.

Another problem, which is common to all previously-known wedges, is a risk that the thin top edge of the wedge facet will stand proud from the wall of the parent hole. Potentially, this could block the path of wireline drilling equipment, motor drilling equipment and reaming equipment required to establish and progress the daughter hole after the wedge has been set in the parent hole.

SUMMARY OF THE INVENTION

Against this background, the present invention provides a method of directional drilling. The method comprises advancing a wedge from a drilling rig to a kick-off point in a parent hole while supporting the wedge distally with respect to a tubular drill string. The wedge is supported via a substantially rigid link that extends along a central longitudinal axis through an annular cutting head to connect the wedge to the drill string.

Conveniently, the wedge may be oriented to a desired azimuth by turning the drill string about the central longitudinal axis to apply torque to the wedge via the link. The wedge is then locked at the kick-off point in the parent hole at the desired azimuth and the connection made by the link between the drill string and the locked wedge is broken, for example by pulling the drill string proximally. The drill string may then be advanced to drill a daughter hole that branches from the parent hole on the azimuth determined by the wedge. The advancing drill string may ream the junction between the parent hole and the daughter hole.

Correspondingly, the inventive concept embraces a directional drilling system, the system comprising: a tubular drill string having an annular cutting head at a distal end; a wedge disposed distally with respect to the cutting head, the wedge comprising a distal locking mechanism for locking the wedge in a hole, attached to a proximal wedge body defining an inclined wedge facet; and a substantially rigid link that connects the wedge to the drill string, the link extending along a central longitudinal axis through the cutting head.

Preferably, the wedge is supported via a dropping mechanism within the drill string. Thus, the link may connect the wedge rigidly to the drill string via the dropping mechanism. In that case, the dropping mechanism may be retrieved to the drilling rig after breaking the connection, for example using a wireline lifting system advanced within the drill string. The dropping mechanism may then be replaced with an inner core tube that is advanced within the drill string before the drill string is advanced to drill the daughter hole.

The inventive concept also embraces the principal parts of the system individually and in combination, for example a wedge for initiating a daughter hole during directional drilling. The wedge comprises: a distal locking mechanism for locking the wedge in a parent hole; a proximal wedge body defining an inclined wedge facet; and a substantially rigid link portion that communicates with the locking mechanism and that extends proximally from the wedge facet along a central longitudinal axis.

Correspondingly, the inventive concept embraces a dropping mechanism for supporting a wedge for use in directional drilling. The dropping mechanism comprises: a latch mechanism for engaging the dropping mechanism within an outer core barrel of a drill string; a substantially rigid link portion extending distally along a central longitudinal axis at a distal end of the dropping mechanism; and a wireline retriever system at a proximal end of the dropping mechanism. The latch mechanism, the link and the wireline retriever system are locked together against relative angular movement about the central longitudinal axis.

At least part of the link may be withdrawn through the cutting head after breaking the connection. For example, the link may be fractured to break the connection while leaving a distal portion of the link embedded in the wedge. It will be noted that in the 'bullnose' prior art, it is not possible to pull part of the link back through the cutting head even though there is a narrow channel for the passage of water. Instead, the bullnose cutting head typically mills away the remaining portion of the link that protrudes from the wedge facet.

Locking energy such as fluid overpressure is preferably applied to a locking mechanism of the wedge via the link, conveniently by diverting drilling fluid through the link to lock the wedge. For example, the link may be in fluid communication with a dump valve that has a valve element movable to divert drilling fluid along the link. Preferably the valve element is movable to divert the drilling fluid along the link in response to the drilling fluid exceeding a threshold pressure.

Aligning force may be applied to the wedge, preferably while locking the wedge, to pivot the wedge about a pivot axis transverse to the central longitudinal axis. This can force a proximal edge of the wedge against a surrounding wall of the parent hole. To achieve this, the wedge may comprise anchor shoes and an alignment shoe disposed proximally relative to the anchor shoes on the same side of the wedge as the wedge facet.

Thus, the wedge of the invention may also be expressed as a wedge for initiating a daughter hole during directional drilling, the wedge comprising: a distal locking mechanism for locking the wedge in a parent hole; and a proximal wedge body having an inclined wedge facet on a side of the wedge; wherein the locking mechanism has outwardly-movable locking shoes comprising anchor shoes and an alignment shoe, the alignment shoe being disposed proximally relative to the anchor shoes and being movable outwardly to the same side of the wedge as the wedge facet.

A corresponding method of setting a wedge for directional drilling comprises: advancing a wedge from a drilling rig to a kick-off point in a hole; locking the wedge at the kick-off point; and before drilling past the wedge, applying aligning force to the wedge to pivot the wedge about a pivot axis transverse to a central longitudinal axis of the hole.

Elegantly, a wireline retriever system at a proximal end of the dropping mechanism, such as a Christensen-type quad latch, may be adapted to serve also as an orientation receiver. That adaptation may comprise a proximally-tapering key formation of the wireline retriever system. In that case, a surveying tool may be adapted to engage with the wireline retriever system at an orientation determined by the key formation.

The locking mechanism may comprise: a hydraulic cylinder in fluid communication with the link; and a rod extending distally from a piston in the cylinder to locking shoes of the wedge. The rod is preferably constrained for unidirectional distal movement within the wedge, for example by extending through a ratchet system. Advantageously, a detent resists movement of the locking shoes until a threshold fluid pressure has been exceeded.

The inventive concept also extends to a method of determining the azimuth of a wedge for use in directional drilling, the method comprising: advancing the wedge along a hole to a kick-off point at which the hole is inclined to the vertical; with reference to gravity, determining a high or low side of the hole at the kick-off point; looking up previously-surveyed azimuth and inclination of the hole at the kick-off point; and determining the azimuth of the wedge with reference to the previously-surveyed azimuth and inclination of the hole, using the high or low side of the hole as a datum, for example using grid reference data.

In summary, therefore, a wedge supported distally ahead of a tubular drill string is advanced along a parent hole in preparation for directional drilling. The wedge is connected to the drill string by a rigid link that extends along a central longitudinal axis through an annular cutting head. The wedge may be connected to the drill string via an inner dropper mechanism that can be engaged by a wireline lifting system.

After locking the wedge at a kick-off point in the hole at a desired azimuth, the connection of the link is broken. The dropper mechanism can then be retrieved and replaced by an inner core tube, without moving the drill string. The drill string is then advanced to drill a daughter hole that branches from the parent hole on the azimuth determined by the wedge. Advantageously, there is no need to withdraw the drill string before drilling the daughter hole can commence.

In general, prior art such as the aforementioned 'bullnose' cutting head does not allow for coring to take place without replacing the cutting head with a coring drill bit. This, disadvantageously, necessitates at least one additional trip.

BRIEF DESCRIPTION OF THE DRAWINGS

In order that the invention may be more readily understood, reference will now be made, by way of example, to the accompanying drawings, in which.

DESCRIPTION OF EXEMPLARY EMBODIMENTS

In the description that follows, the bottom, lower or downward end or direction will be referred to as 'distal' or 'distally'. Conversely, the top, upper or upward end or direction will be referred to as 'proximal' or 'proximally'. This reflects that the invention may be used in holes that, in some circumstances, could extend horizontally or upwardly and not just downwardly.

Overview of the Wedge System

Figure 1:
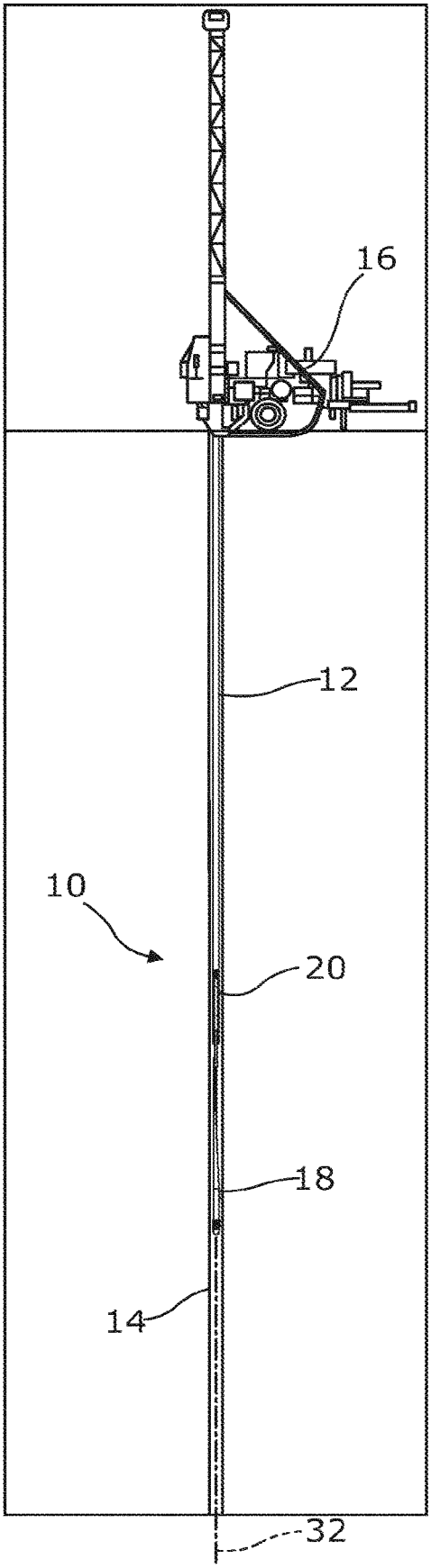
FIG. 1 is a schematic side view of a drilling rig lowering a wedge system of the invention into a parent hole.

Referring firstly to FIG. 1 of the drawings, a wedge system 10 in accordance with the invention is shown here suspended from a drill string 12 in a parent hole 14. The drill string 12 extends distally into the hole 14 from a conventional drilling rig 16 at the surface.

The wedge system 10 comprises a wedge 18 that is suspended from a dropping mechanism 20 at the depth of the desired KOP. The dropping mechanism 20 is suspended, in turn, from the drill string 12.

Figure 2:
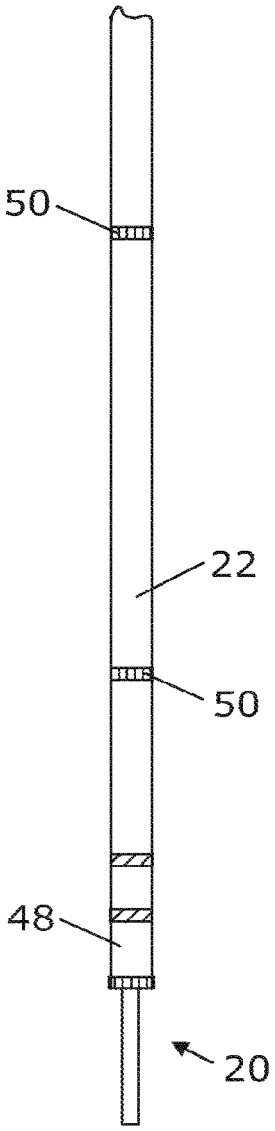
FIG. 2 is a schematic side view of an outer core barrel of a drill string, containing a dropping mechanism of the wedge system.
Figure 3:
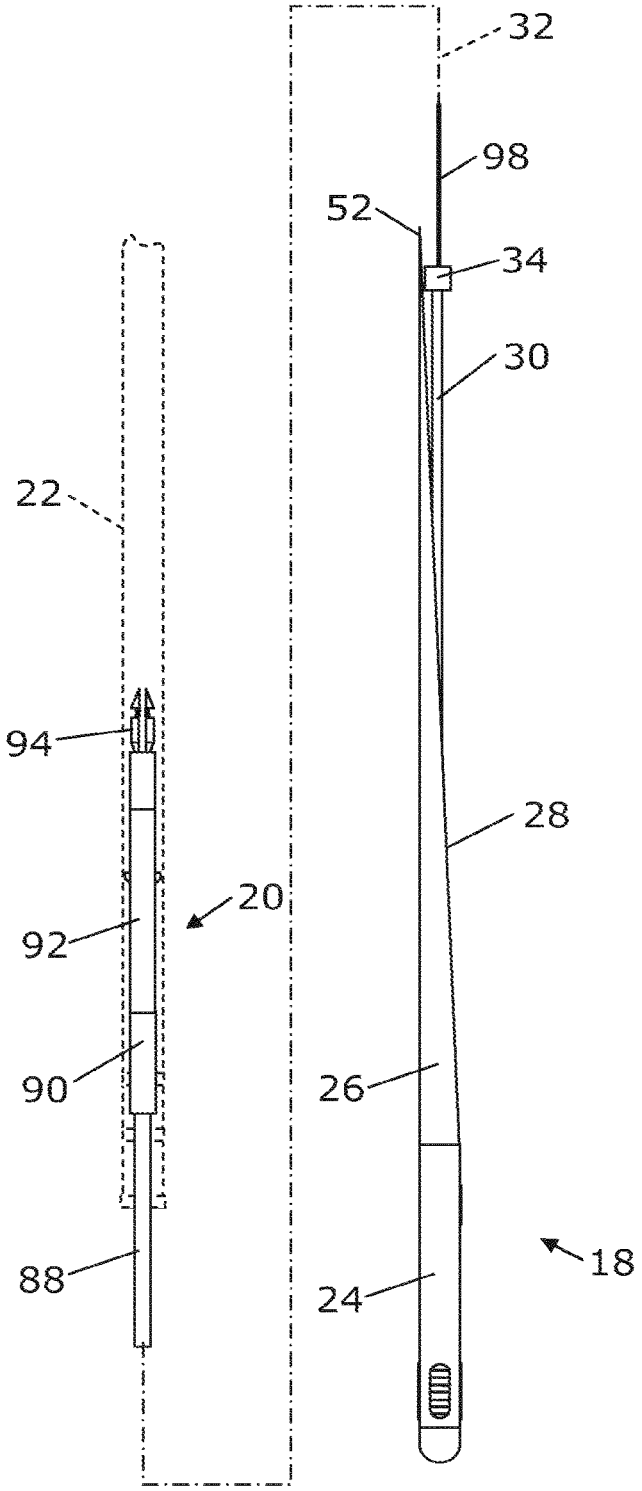
FIG. 3 is a schematic side view showing the outer core barrel sectioned to reveal the dropping mechanism and also showing a wedge of the wedge system.

Referring now also to FIGS. 2 and 3, the dropping mechanism 20 is received telescopically within an outer core barrel 22 at the distal end of the drill string 12. The outer core barrel 22 will typically be four metres long.

The dropping mechanism 20 is removably engaged within the outer core barrel 22. When so engaged, the dropping mechanism 20 can be lifted proximally but cannot move distally relative to the outer core barrel 22. Consequently, the outer core barrel 22 and the remainder of the drill string 12 carry the weight of the dropping mechanism 20 and the wedge 18.

The wedge 18 shown in FIG. 3 comprises a locking mechanism 24 that is fixed to a distal end of a proximally-tapering wedge body 26. Whilst it is fixed to the wedge body 26 in use, the locking mechanism 24 could be separated from the wedge body 26 before use for ease of handling and transport. The wedge body 26 has an inclined wedge facet 28 that, in use, will divert the drill string 12 into a daughter hole to be branched from the parent hole 14. Thus, when activated, the locking mechanism 24 engages the surrounding wall of the hole 14 to lock the wedge 18 immovably in the hole 14.

Elegantly, in the preferred embodiment to be described, the locking mechanism 24 is activated using the drilling fluid, preferably water, that is pumped down the drill string 12. There is no need for a separate hydraulic actuation system.

In principle, other actuation systems such as electric or pneumatic systems could be used to activate the locking mechanism 24. However, the use of a drilling fluid such as water is much preferred for its simplicity and effectiveness. For example, despite great hydrostatic pressure in the hole 14 at depth, a relatively small increase in water pressure applied at the surface is sufficient to activate the locking mechanism 24 and to set the wedge 18.

To apply the necessary hydraulic overpressure, a rigid wedge pipe 30 on the central longitudinal axis 32 penetrates the wedge facet 28 to effect fluid communication with the locking mechanism 24. The wedge pipe 30 allows water flowing along the drill string 12 to apply activating pressure distally to the locking mechanism 24 through the wedge facet 28.

The wedge pipe 30 has a male thread at its proximal end, with which a lock nut 34 is engaged. The lock nut 34 allows the wedge pipe 30 to be coupled fluidly and mechanically with the dropping mechanism 20 on the proximal end of the wedge 18, as will be explained later.

Figure 4:
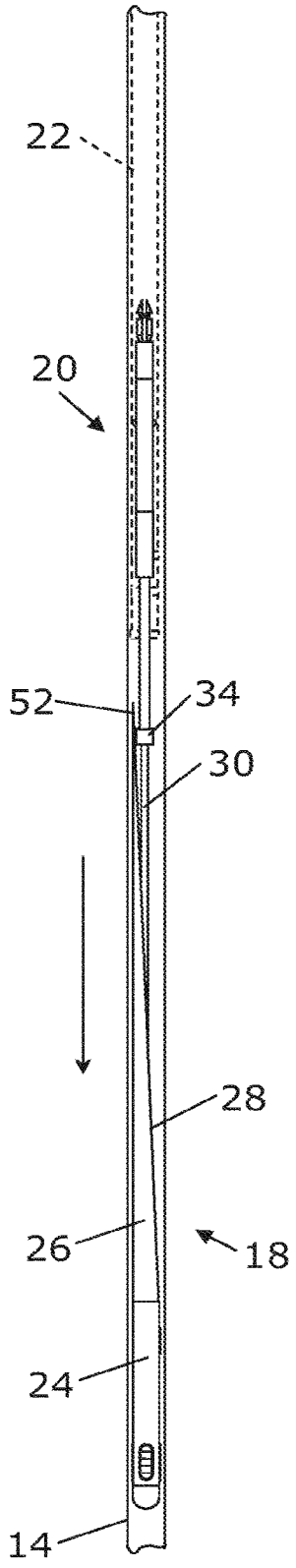
FIGS. 4 to 12 are a sequence of schematic side views showing the wedge system in operation down the hole.
Figure 5:
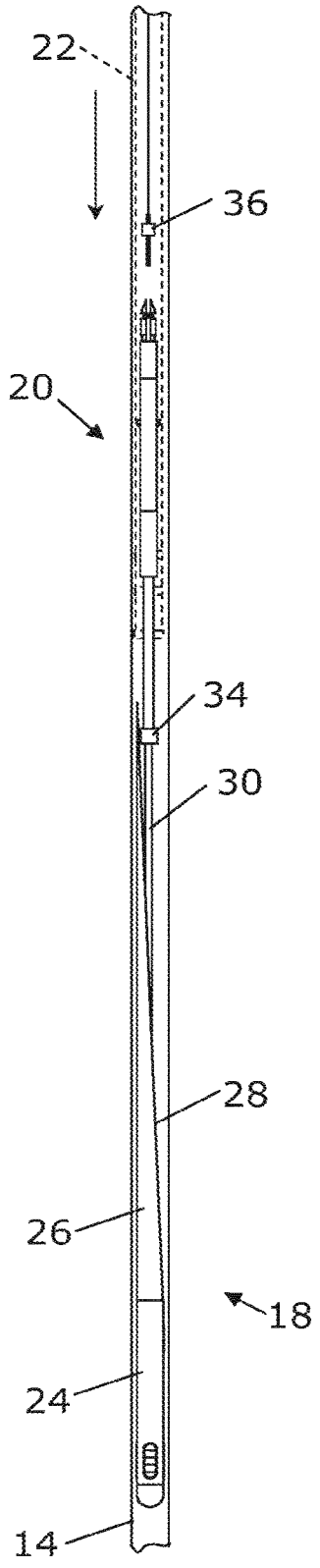
Figure 6:
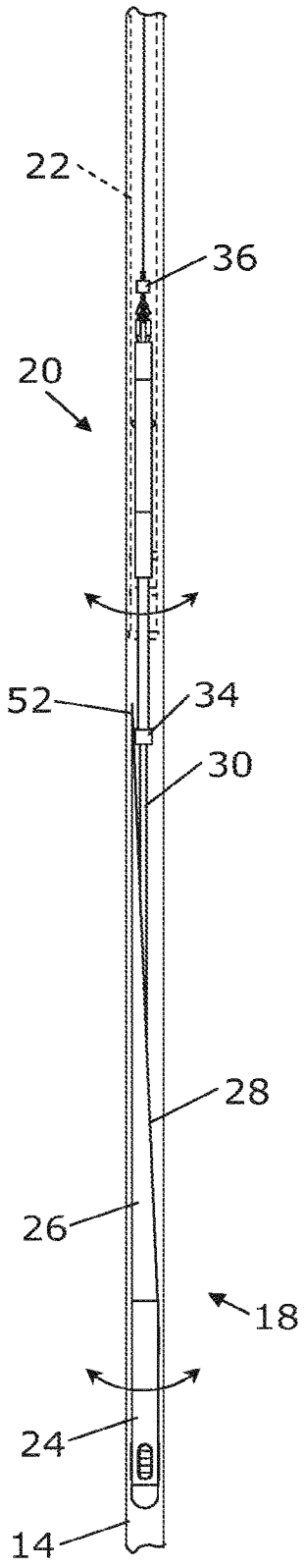

FIGS. 4 to 6 shows the wedge system 10 suspended from the outer core barrel 22 of a drill string 12 at the KOP in the parent hole 14. Specifically, FIG. 4 shows the wedge system 10 having just been lowered to the KOP. FIG. 5 shows a surveying tool 36 being lowered into engagement with the dropping mechanism 20. FIG. 6 shows the surveying tool 36 now engaged with the dropping mechanism 20 to determine its azimuth and hence the azimuth of the wedge facet 28.

Typically the surveying tool 36 will be lifted to the surface after its engagement with the dropping mechanism 20 so that the sensed azimuth can be read. If the sensed azimuth departs from the desired azimuth, the dropping mechanism 20 and the wedge 18 can be turned by turning the drill string 12 as appropriate to achieve the desired azimuth. However, it is good practice to lower the surveying tool 36 back into engagement with the dropping mechanism 20 and then to lift the surveying tool 36 to the surface again to verify that the desired azimuth has been achieved.

When the drill string 12 including the outer core barrel 22 is turned about its longitudinal axis 32 as shown in FIG. 6, the outer core barrel 22 can also apply torque to turn the dropping mechanism 20 and hence to turn the wedge 18 within the hole 14. This orients the wedge facet 28 of the wedge body 26 to match the azimuth required for the daughter hole.

Figure 7:
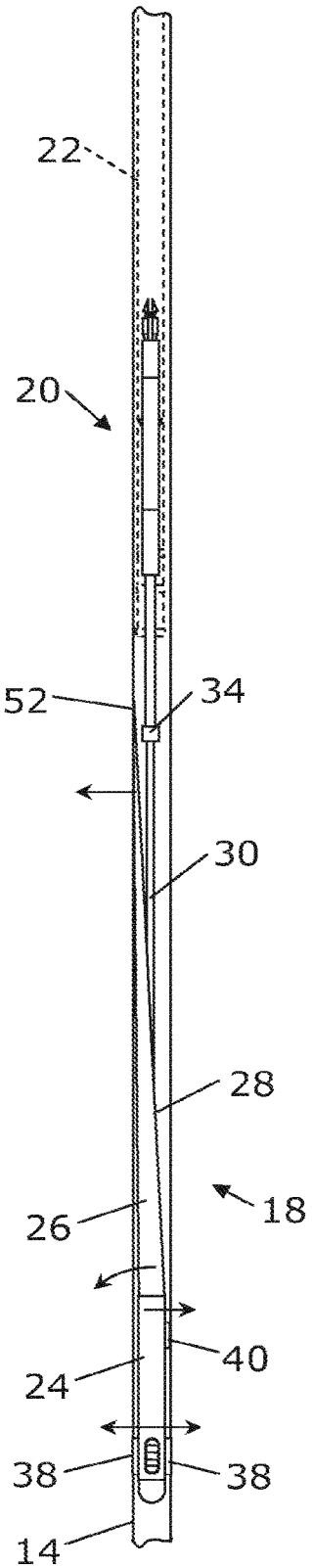

FIG. 7 shows the locking mechanism 24 now activated to set the wedge 18 at the desired depth and azimuthal orientation. On being activated, anchor shoes 38 and an alignment shoe 40 project laterally from the locking mechanism 24 into engagement with the surrounding wall of the hole 14. The operation of the locking mechanism 24 will be explained in detail later with reference to FIGS. 16 to 21.

Figure 8:
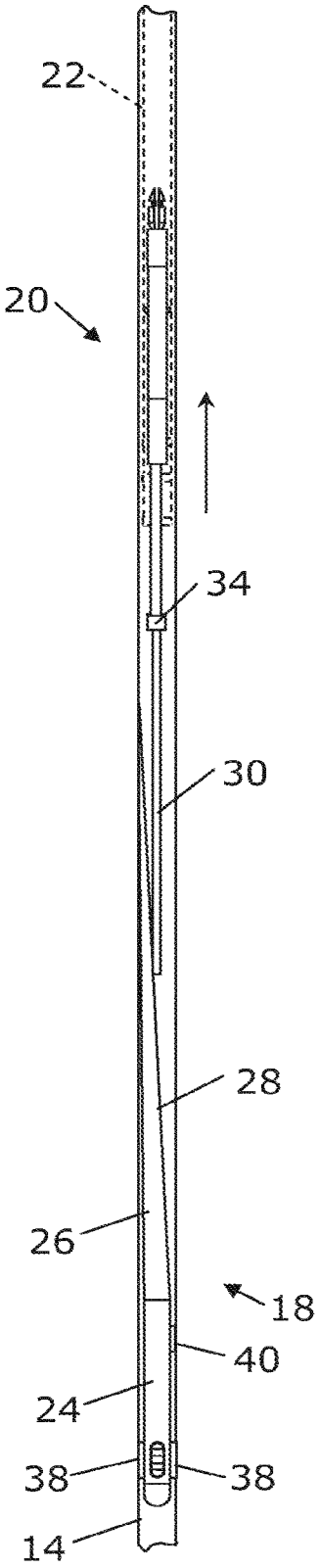

Next, as shown in FIG. 8, the drill string 12 including the outer core barrel 22 pulls the dropping mechanism 20 proximally to break the connection between the dropping mechanism 20 and the set wedge 18, which remains fixed in the hole 14. This is achieved by breaking the wedge pipe 30 at a predetermined weak point, as will be described later.

Figure 9:
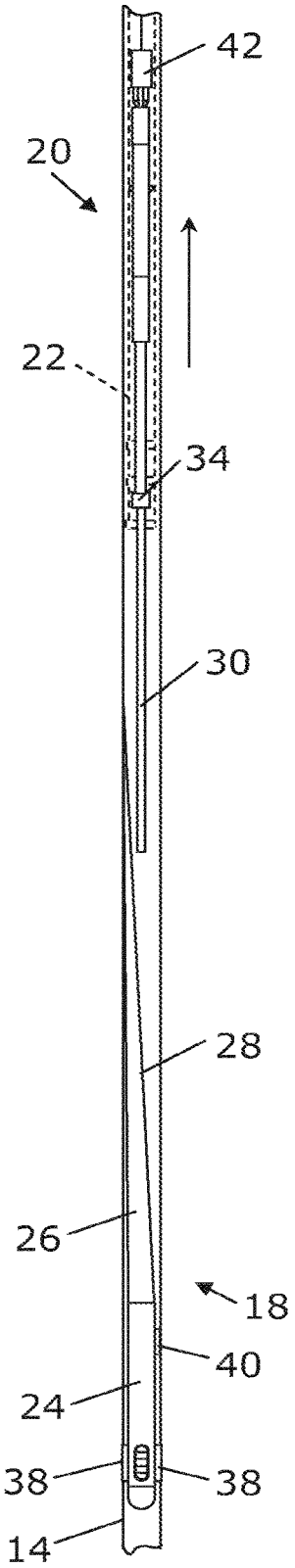
Figure 10:
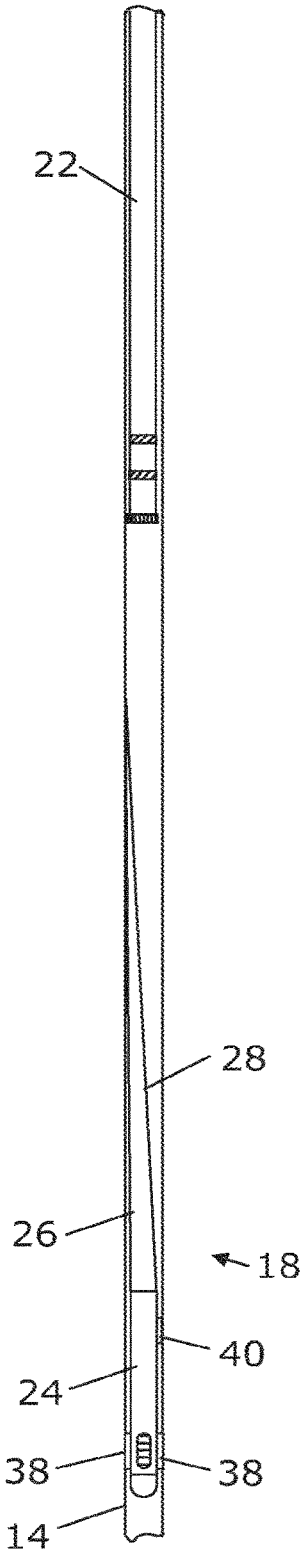

The dropping mechanism 20 can then be disengaged from the outer core barrel 22 to be pulled proximally by a wireline lifting system 42 relative to the outer core barrel 22 as shown in FIG. 9. This allows the dropping mechanism 20 to be retrieved to the surface on a wire after the wedge 18 has been set and the dropping mechanism 20 has been separated from the wedge 18. The outer core barrel 22 remains in the hole 14 at the distal end of the drill string 12 as shown in FIG. 10.

Figure 11:
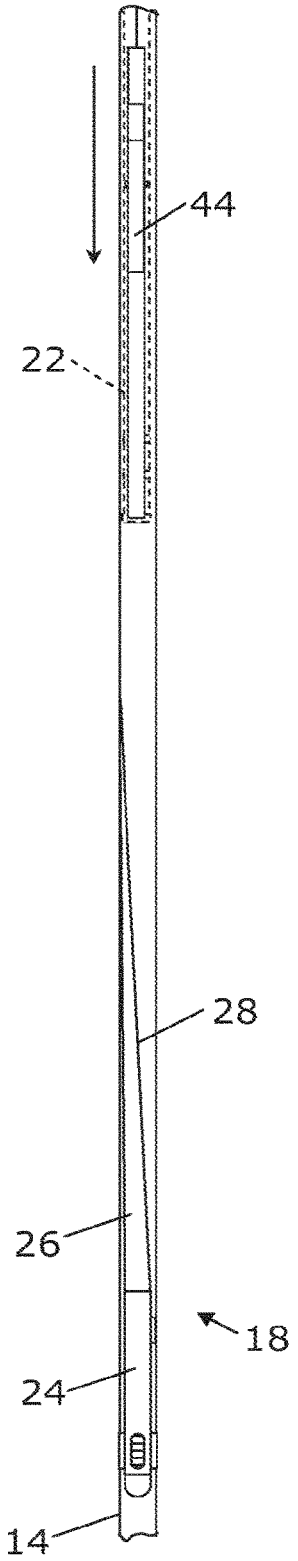
Figure 12:
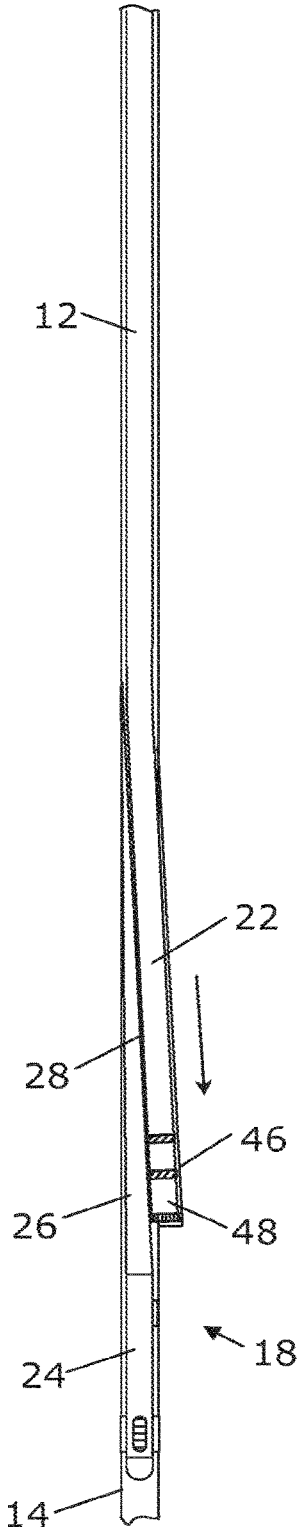

An inner core tube 44 can then be lowered and inserted telescopically into the outer core barrel 22 to replace the dropping mechanism 20 as shown in FIG. 11, using conventional wireline drilling techniques. The drill string 12 is then ready to start drilling past the wedge 18 to initiate the daughter hole 46 as shown in FIG. 12.

It will be apparent that the outer core barrel 22, including its distal cutting head 48, is lowered together with the wedge 18 and the dropping mechanism 20 into the hole 14 and then remains positioned proximally just above the wedge 18. This places the drill string 12 ready to start drilling past the wedge 18 once the wedge 18 has been set in the hole 14. Importantly, therefore, there is no need to waste time on a further trip to the surface and back before drilling the daughter hole 46 can commence.

Advantageously, the outer core barrel 22 may be a reaming core barrel. A reaming core barrel is encircled by circumferential reaming inserts 50 that are spaced longitudinally from the cutting head 48 near the distal end. The reaming inserts 50 ream the intersection between the parent hole 14 and the daughter hole 46. This removes the need to lower additional reaming equipment and hence avoids another trip of a rod string.

The Wedge

Figure 13:
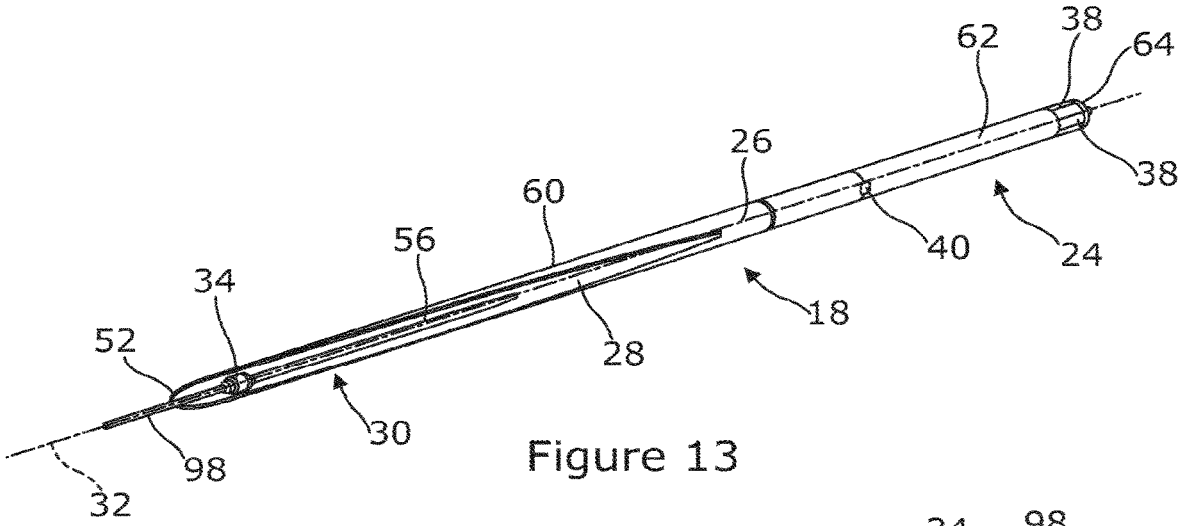
FIGS. 13 to 15 are a selection of perspective views of the wedge.
Figure 14:
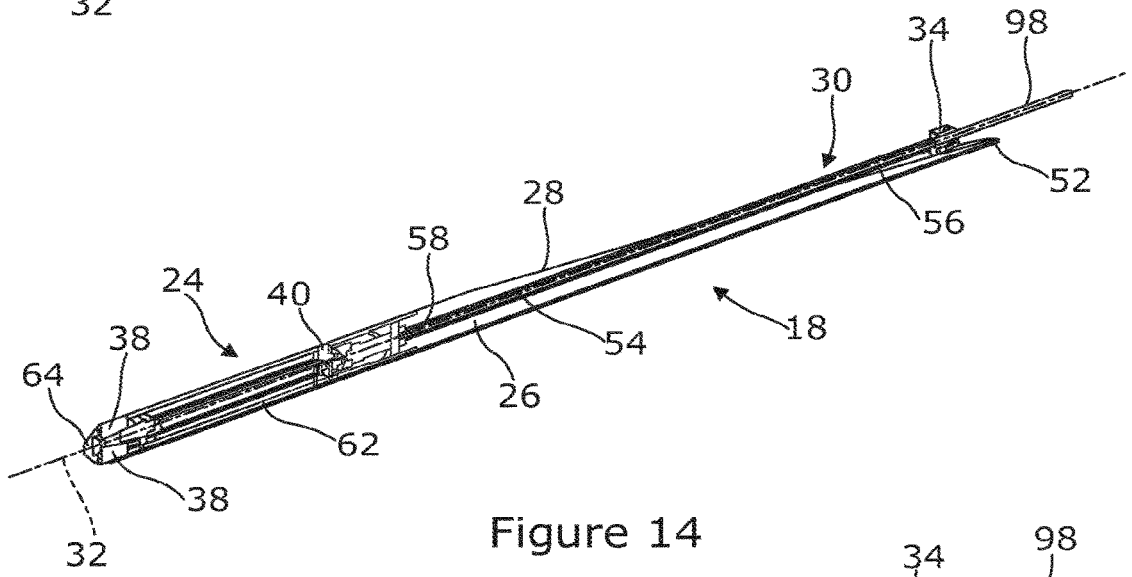
Figure 15:
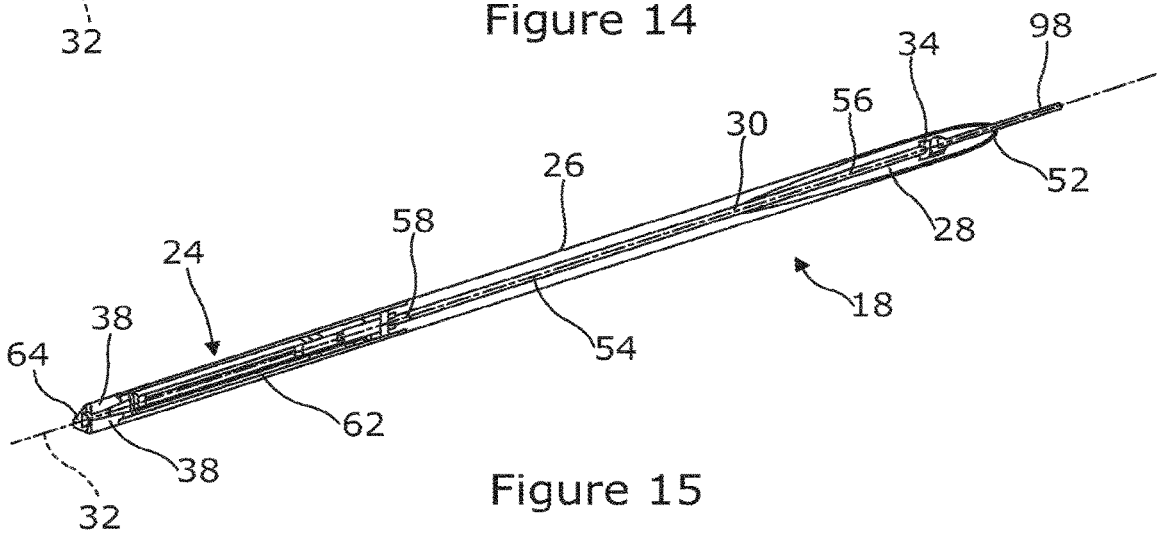
Figure 16:
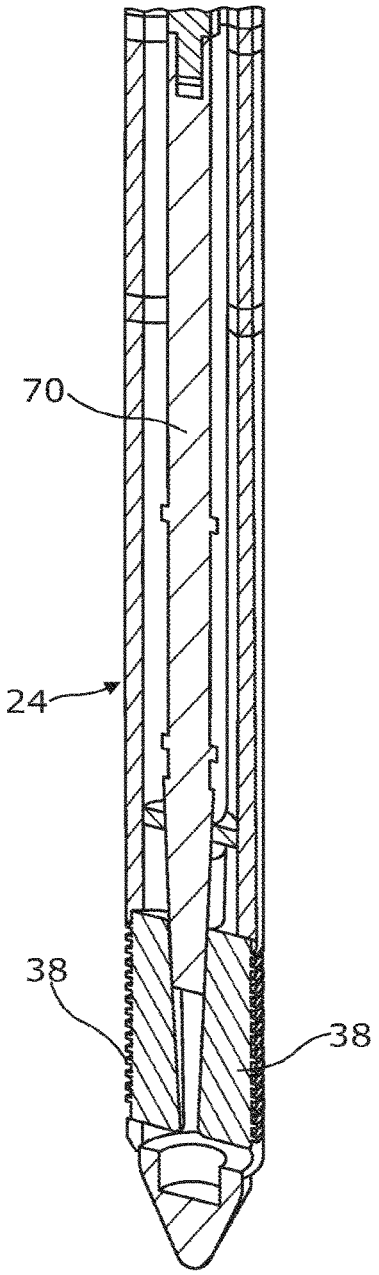
FIGS. 16 to 18 are a sequence of perspective views showing the operation of a locking mechanism of the wedge.
Figure 17:
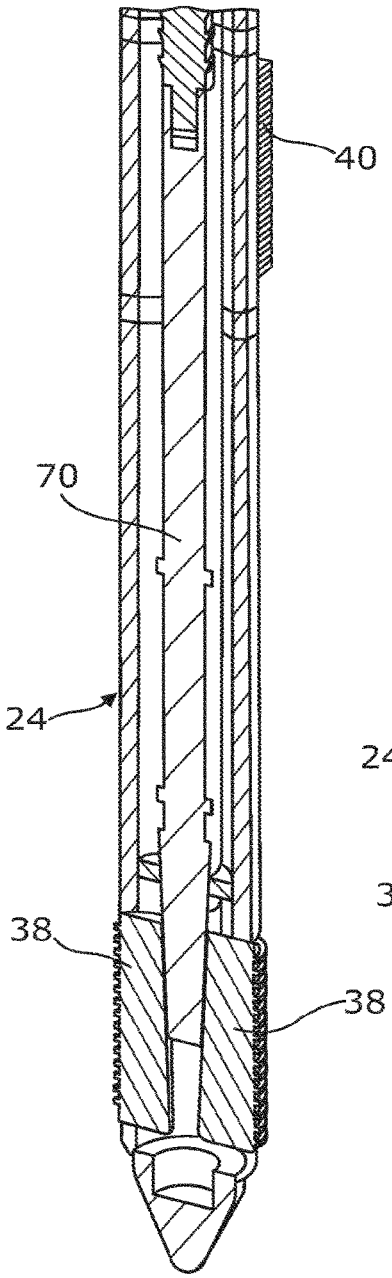
Figure 18:
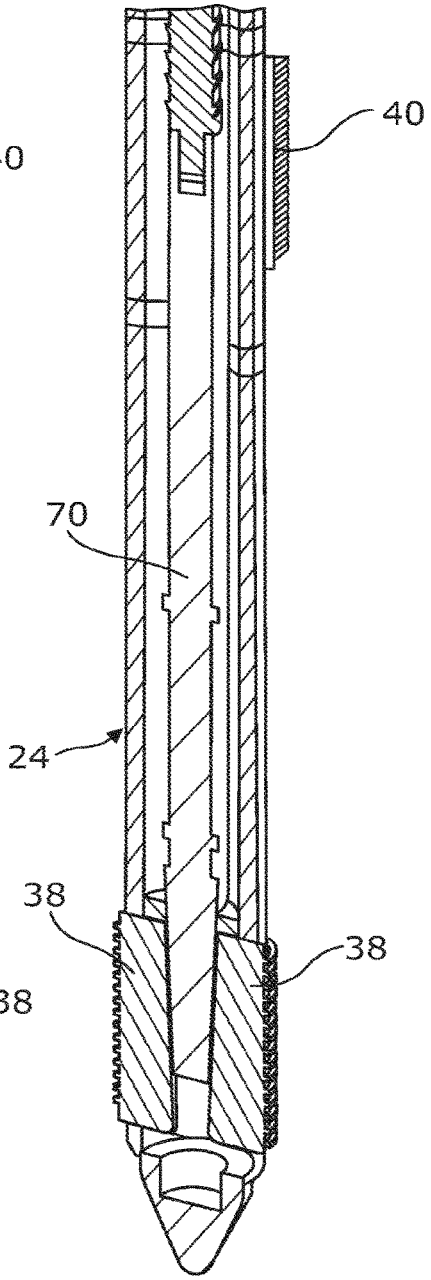

Reference is now made additionally to FIGS. 13 to 15, which show the wedge 18 in isolation. FIGS. 14 and 15 show the wedge 18 sectioned longitudinally in mutually orthogonal planes.

The locking mechanism 24 of the wedge 18 is fixed to, and disposed distally with respect to, the proximally-tapering wedge body 26.

The part-cylindrical, convex-curved wedge facet 28 is defined by the taper of the wedge body 26. The wedge facet 28 is inclined shallowly with respect to a central longitudinal axis 32 and ends in a thin convex-curved proximal edge 52. The radius of curvature of the wedge facet 28 and its proximal edge 52 approximates to that of a parent hole 14 into which the wedge 18 is to be placed.

It will be apparent that when the wedge 18 has been placed in the parent hole 14, the central longitudinal axis 32 substantially corresponds to the central longitudinal axis 32 of the hole 14.

A distal portion 54 of the wedge pipe 30 extending to the locking mechanism 24 is embedded in the wedge body 26 on a distal side of the wedge facet 28. Conversely, a proximal portion 56 of the wedge pipe 30 is exposed on a proximal side of the wedge facet 28.

The wedge pipe 30 has a line of weakness 58 on the distal side of the wedge facet 28, in the distal portion 54 embedded in the wedge body 26. For example, the wedge pipe 30 may have a locally-thinned wall section by virtue of a circumferential groove. This line of weakness 58 provides for the wedge pipe 30 to fracture under tension exceeding a threshold value. The necessary tension is applied to the wedge pipe 30 by hydraulic pull-back of the drilling rig 16 to pull upwardly on the drill string 12. The wedge pipe 30 then divides into two separate portions a shown in FIG. 8.

When the wedge pipe 30 has been fractured and divided in this way, the dropping mechanism 20 can be withdrawn from the hole 14 as shown in FIG. 9. This includes the portion of the wedge pipe 30 on the proximal side of the fracture that remains attached to the dropping mechanism 20.

The reverse side 60 of the wedge body 26 opposed to the wedge facet 28 is part-cylindrical. The wedge body 26 may therefore be regarded as a cylinder from which an inclined part-cylindrical portion has been cut away, the concave curvature of that cut-away portion defining the wedge facet 28.

The locking mechanism 24 has a cylindrical housing 62 whose radius of curvature matches that of the part-cylindrical reverse side 60 of the wedge body 26. That radius is selected to be a close sliding fit within the hole 14. The housing 62 has a tapered, rounded or bull-nosed distal end 64 to ease distal movement of the wedge 18 along the hole 14 to the depth of the KOP.

The operation of the locking mechanism 24 will now be explained with reference to FIGS. 16 to 21.

The housing 62 has four equi-angularly spaced openings near its distal end that accommodate respective anchor shoes 38 in a cruciform arrangement. The anchor shoes 38 are movable radially outwardly with respect to the central longitudinal axis 32 in mutually orthogonal radial planes.

When moved in radially-outward directions within the parent hole 14, the anchor shoes 38 bear against the surrounding wall of the hole 14 to lock the wedge 18 at the desired KOP, as also shown in FIGS. 7 to 12. For this purpose, the anchor shoes 38 are toothed to grip the wall of the hole 14. Conveniently, the single locking operation also sets the wedge facet 28 at the desired azimuth, i.e. the desired angle of orientation with respect to the central longitudinal axis 32 to match the intended azimuthal direction of a daughter hole 46 to be initiated at the KOP.

The housing 62 has a further laterally-facing opening that is spaced proximally from the anchor shoes 38, closer to the wedge body 26. This further opening accommodates a single radially-movable alignment shoe 40 that moves in a radially-outward direction within the hole 14 at the same time as the anchor shoes 38.

The purpose of the alignment shoe 40 is to bear against the surrounding wall of the hole 14 to pivot the wedge 18 slightly about a horizontal fulcrum defined by the anchor shoes 38. The direction of pivoting is such as to force the proximal edge 52 of the wedge facet 28 firmly against the adjacent wall of the hole 14 as shown in FIGS. 7 to 12. This helps to embed the proximal edge 52 into the wall of the hole 14, which prevents the proximal edge 52 blocking distal movement of the outer core barrel 22 in subsequent drilling operations to initiate a daughter hole 46.

Thus, the alignment shoe 40 moves in a direction that faces the same way as the wedge facet 28 with respect to the central longitudinal axis 32. In other words, the alignment shoe 40 moves in a direction opposed to the part-cylindrical side of the wedge body 26 that is on the reverse of the wedge facet 28.

In this example, the alignment shoe 40 moves in the same radial plane as an opposed pair of the anchor shoes 38 near the distal end of the housing 62. However, it would be possible for the alignment shoe 40 to move in a different radial plane, provided that its action pushes the proximal edge 52 of the wedge facet 28 in the required direction.

The locking mechanism 24 of the wedge 18 comprises a hydraulic cylinder 66 at the proximal end in fluid communication with the distal end of the wedge pipe 30. A piston 68 can move distally within the cylinder 66 in response to fluid pressure applied to the cylinder 66 via the wedge pipe 30. Distal movement of the piston 68 drives distal movement of a longitudinally-extending rod 70 attached to the piston 68. The rod 70 is supported by bearings 72 within the housing 62 for distal sliding movement along the housing 62.

Figure 19:
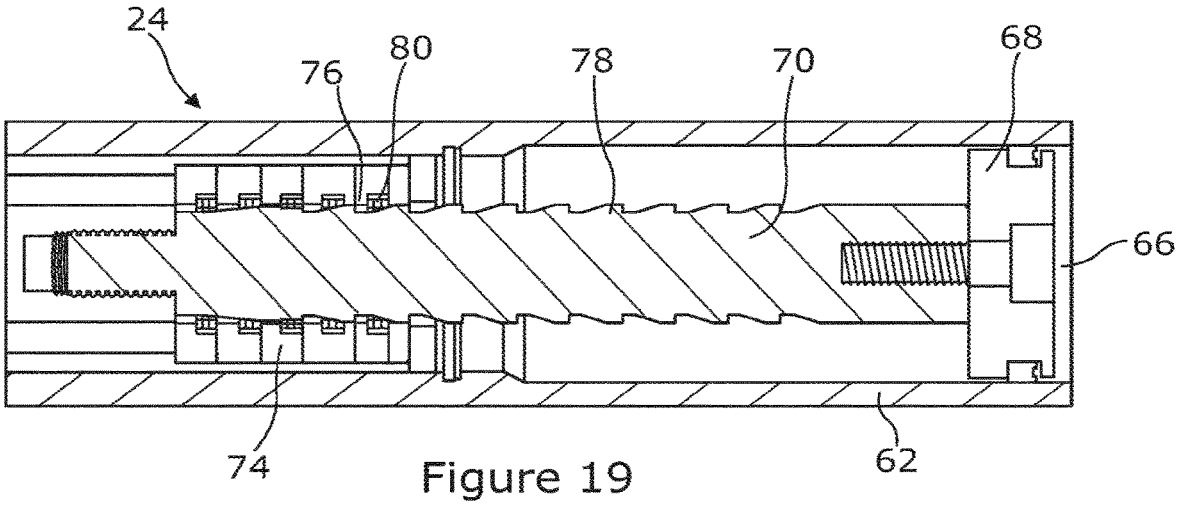
FIG. 19 is a side view in longitudinal section of a ratchet unit of the locking mechanism.

FIG. 19 shows that a proximal portion of the rod 70 extends through a non-return ratchet unit 74 that allows only unidirectional distal movement of the rod 70. For this purpose, the ratchet unit 74 comprises a longitudinal succession of inwardly-facing, inwardly-biased teeth 76 that can engage with a longitudinal succession of outwardly facing teeth 78 on the proximal section of the rod 70.

Advantageously, each tooth 76 of the ratchet unit comprises a group of relatively thin independently-movable leaves 80. This reduces slack between the rod 70 and the ratchet unit 74 by ensuring that even a small movement of the rod 70 will engage another one of the leaves 80 rather than having to cover the full longitudinal distance from one tooth 76 to the next.

Figure 20:
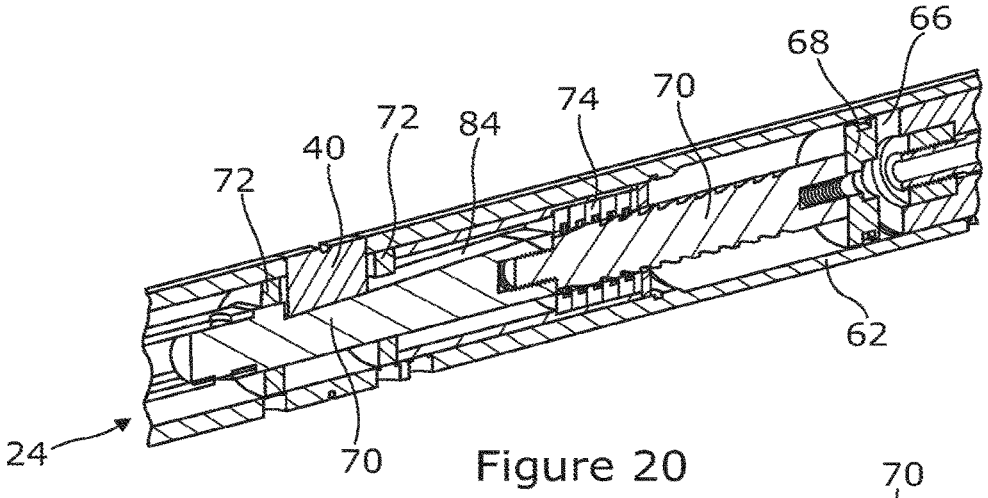
FIG. 20 is an enlarged perspective view in longitudinal section showing the operation of an alignment shoe of the locking mechanism.
Figure 21:
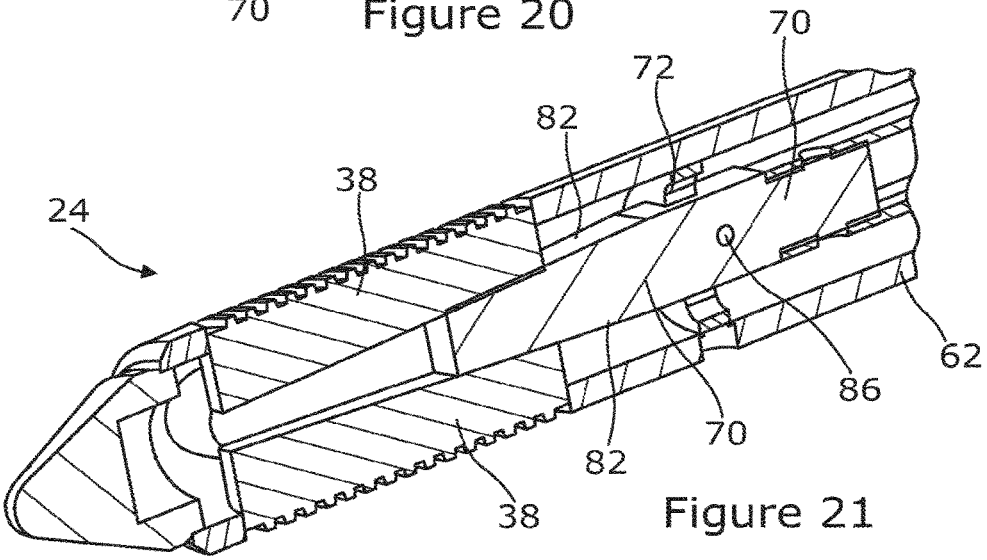
FIG. 21 is an enlarged perspective view in longitudinal section showing the operation of anchor shoes of the locking mechanism.

As best shown in FIGS. 20 and 21, a distal portion of the rod 70 has distally-tapering parts that define inclined cam surfaces 82, 84 aligned, respectively, with the anchor shoes 38 and the alignment shoe 40. By virtue of those cam surfaces 82, 84, distal movement of the rod 70 drives radially-outward movement of the anchor shoes 38 and the alignment shoe 40 when locking the wedge 18 in the hole 14.

To ensure that the locking mechanism 24 cannot be activated prematurely or accidentally, the rod 70 is restrained by a safety pin 86 shown in FIG. 21 that extends transversely into the rod from one of the bearings 72 in the surrounding housing 62. The safety pin 86 shears to free the rod 70 for distal movement only when a threshold pressure has been applied to the rod 70 via the piston 68 in the cylinder 66.

The Dropping Mechanism

As shown schematically in FIG. 3, the dropping mechanism 20 is an elongate assembly that is dimensioned to fit telescopically within the outer core barrel 22. In succession, moving proximally, the dropping mechanism 20 comprises a hollow rigid connecting tube 88 at a distal end, a dump valve 90, a latch mechanism 92 and a retriever guide system 94 at a proximal end.

Figure 22:
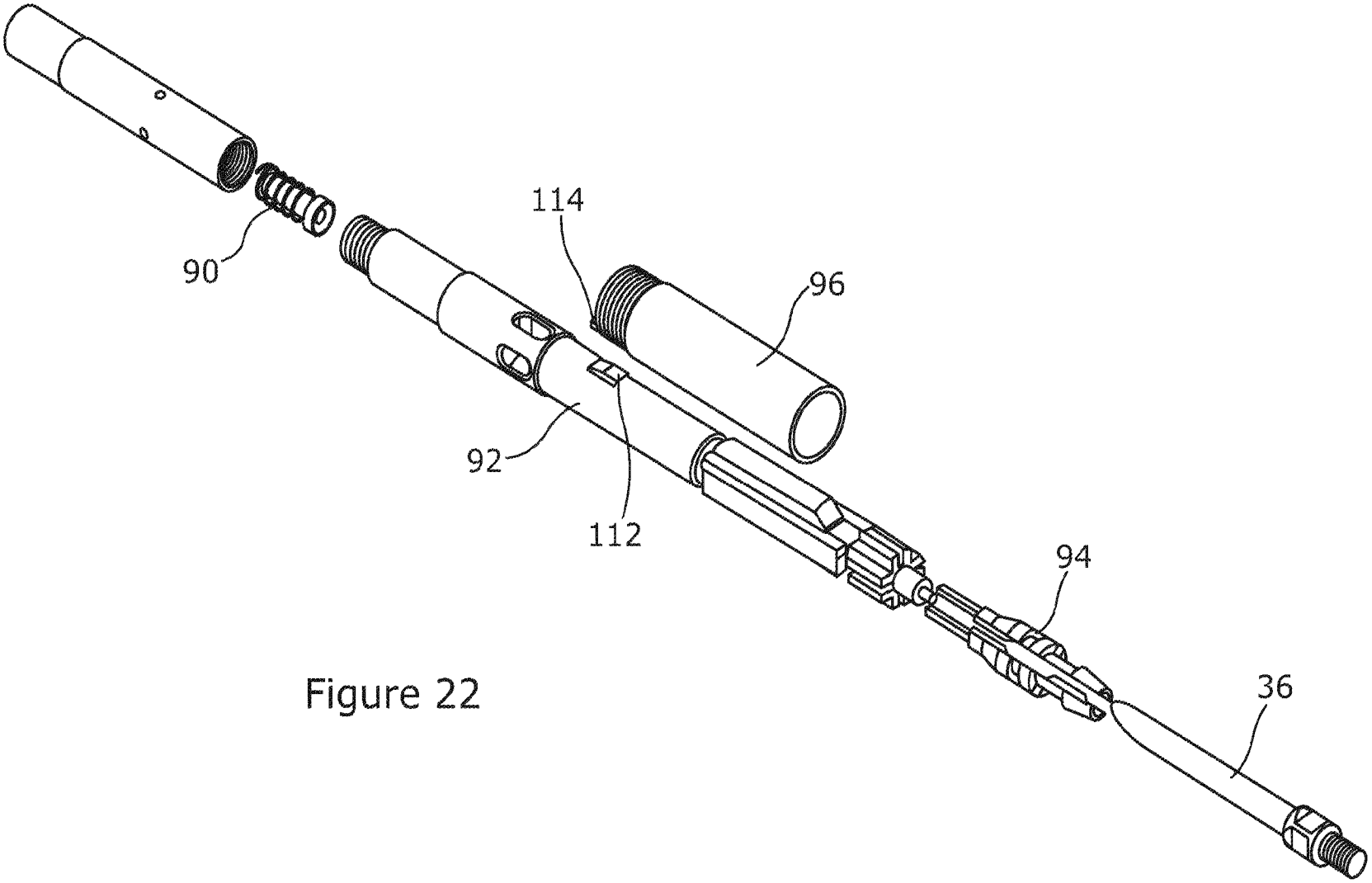
FIG. 22 is an exploded perspective view of parts of the dropping mechanism other than the connecting tube.

FIG. 22 omits the connecting tube 88 but shows the other parts of the dropping mechanism 20, namely, the dump valve 90, the latch mechanism 92 and the retriever guide system 94. These parts will be described in more detail later with reference to FIGS. 27 to 29.

FIG. 22 also shows a sleeve 96 forming part of the outer core barrel 22, which interacts with the latch mechanism 92 as will be described with reference to FIG. 28. The surveying tool shown schematically in FIGS. 5 and 6 is also shown in FIG. 22 and will be described more fully with reference to FIG. 30.

When assembling the wedge system 10 at the surface, the wedge 18 is supported by a clamp mechanism of the drilling rig 16 and the dropping mechanism 20 is hoisted above the proximal end of the wedge 18. Angular alignment about a vertical axis is established between the dropping mechanism 20 and the wedge 18. The connecting tube 88 is then coupled end-to-end with the wedge pipe 30 to enable fluid communication between the connecting tube 88 and the wedge pipe 30 for activating the locking mechanism 24 of the wedge 18.

Figure 23:
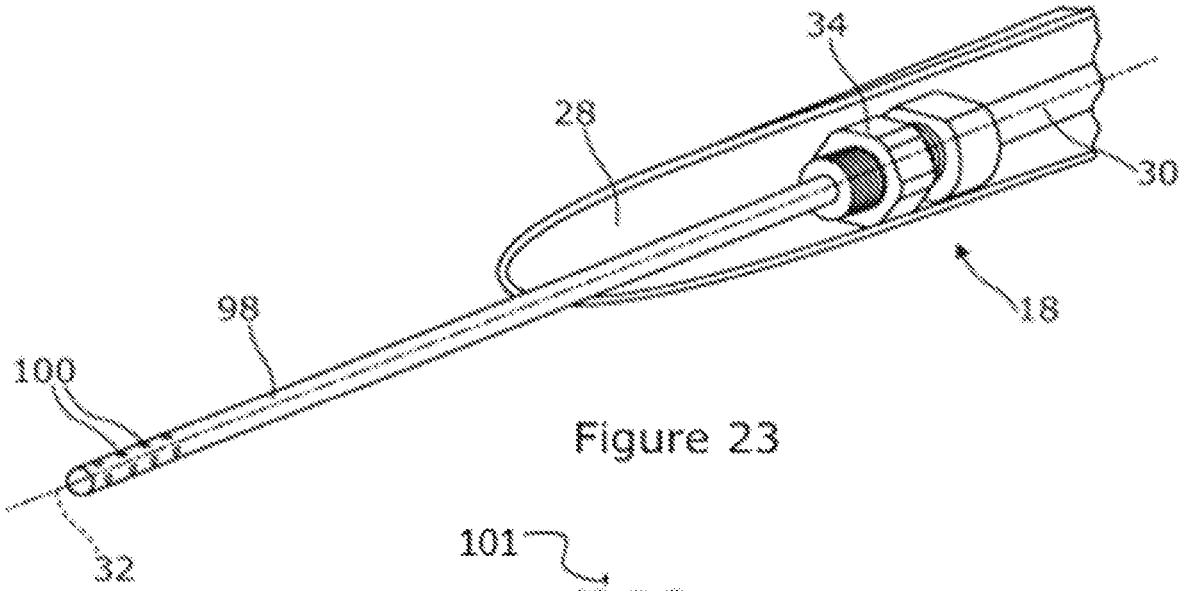
FIG. 23 is an enlarged perspective view of a spear tube at a proximal end of the wedge.

Optionally, as best shown in FIG. 23, the wedge pipe 30 of the wedge 18 terminates in, and communicates fluidly with, a narrower spear tube 98 that projects proximally from the wedge pipe 30 beyond the lock nut 34. A distal end of the spear tube 98 has a male thread that can be screwed into a complementary female thread within the proximal end of the wedge pipe 30. The spear tube 98 has a closed distal end but the wall of the spear tube 98 is penetrated by multiple lateral openings 100 near the distal end.

Figure 24:
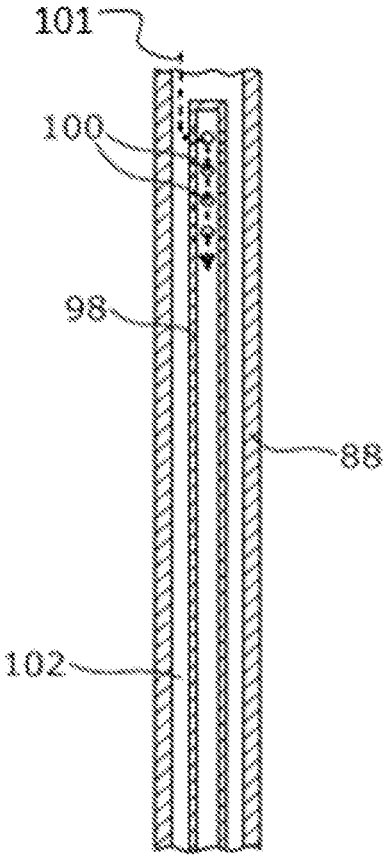
FIG. 24 is an enlarged schematic side view in longitudinal section, showing the spear tube within a connecting tube at a distal end of the dropping mechanism.

With reference now also to FIG. 24, the spear tube 98 on the proximal end of the wedge pipe 30 extends proximally into the connecting tube 88 of the dropping mechanism 20. The spear tube 98 and the surrounding connecting tube 88 are then in telescopic relation, leaving a narrow annular space 102 between them.

Water that flows from the drill string 12 along the connecting tube 88 enters the spear tube 98 through the lateral openings 100 near the distal end of the spear tube 98. As the water does so, sand and silt entrained in the water tends to settle distally out of the flow under gravity and hence into the annular space 102 between the spear tube 98 and the connecting tube 88, where the solid particles are trapped. This significantly reduces the amount of particulate material that the water carries into the locking mechanism 24 via the spear tube 98 and the wedge pipe 30, to the benefit of reliability.

Figure 25:
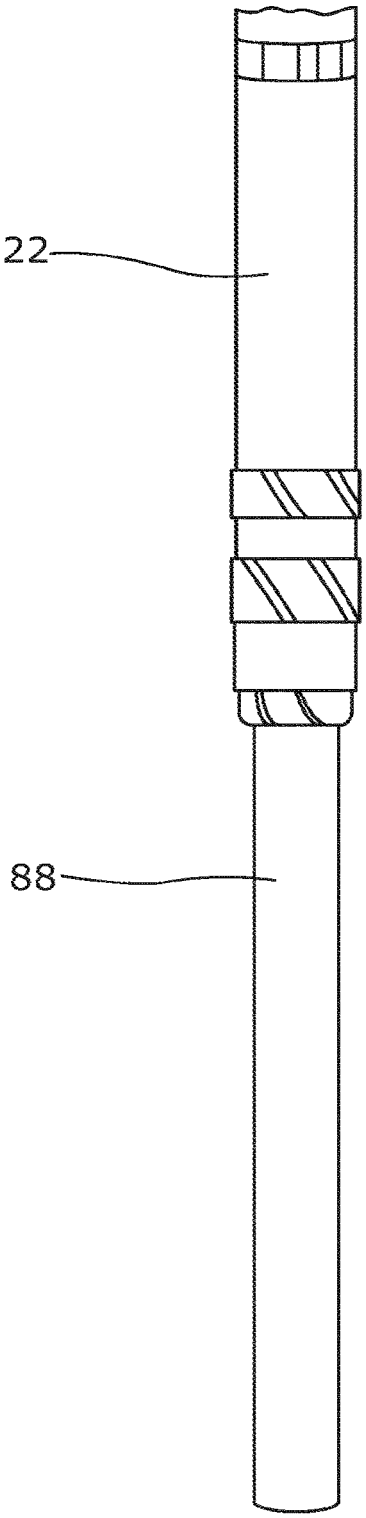
FIG. 25 is a schematic side view showing the connecting tube protruding from a distal end of the outer core barrel.
Figure 26:
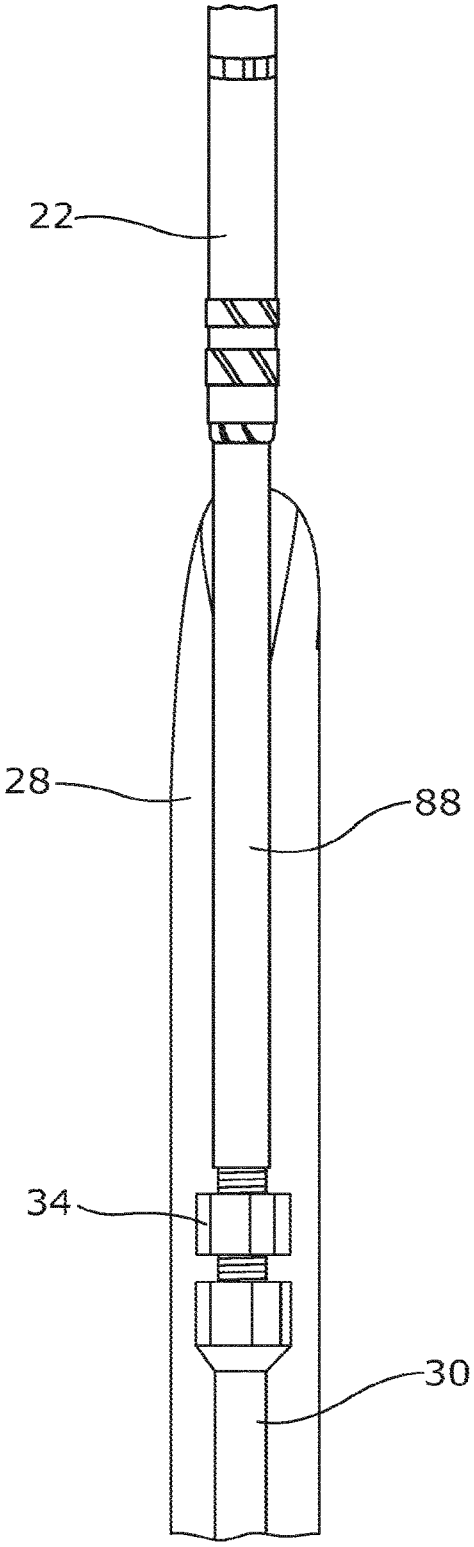
FIG. 26 is a schematic side view showing the connecting tube engaged with a wedge pipe at the proximal end of the wedge.

When the dropping mechanism 20 is seated fully within the outer core barrel 22, the connecting tube 88 projects distally about half a metre beyond the cutting head at the distal end of the outer core barrel 22 as shown in FIG. 25. This facilitates end-to-end coupling of the connecting tube 88 to the wedge pipe 30 when supported by the drilling rig 16. For this purpose, the connecting tube 88 has a male thread at its distal end for engagement with the aforementioned lock nut 34 on the proximal end of the wedge pipe 30, as shown in FIG. 26.

The lock nut 34 couples the connecting tube 88 to the wedge pipe 30 not just fluidly but also mechanically. Thus, the connecting tube 88 and the connected wedge pipe 30 can each bear the axial weight load of the wedge 18 when the wedge system 10 is suspended from a drill string 12 in a hole 14. The connecting tube 88 and the connected wedge pipe 30 are also locked together against relative angular movement. The connecting tube 88 and the wedge pipe 30 can therefore also transmit torque to turn the wedge 18 when the drill string 12 and the dropping mechanism 20 are turned together within the hole 14.

The retriever guide system 94 is preferably hinged to the latch mechanism 92 to allow the retriever guide system 94 to pivot relative to the remainder of the otherwise rigid dropping mechanism 20. This facilitates lifting the dropping mechanism 20 from a horizontal orientation on the surface into a vertical orientation on the drilling rig 16 for insertion into the hole 14. However, all parts of the dropping mechanism 20 are locked together against relative angular movement around its central longitudinal axis 32.

It follows that, when in the hole 14, the angular orientation of the connecting tube 88 at the distal end of the dropping mechanism 20 must always follow the angular orientation of the retriever guide system 94 at the proximal end of the dropping mechanism 20. Determining the angular orientation of the retriever guide system 94 within the hole 14 therefore determines the angular orientation of the connecting tube 88 within the hole 14.

Further, as the connecting tube 88 and the connected wedge pipe 30 are locked together against relative angular movement, the angular orientation of the wedge 18 must always follow the angular orientation of the retriever guide system 94 at the proximal end of the dropping mechanism 20. Consequently, determining the angular orientation of the retriever guide system 94 within the hole 14, as will be explained below, determines the angular orientation of the wedge 18 that is angularly locked at a known orientation with respect to the connecting tube 88. This therefore determines the azimuthal alignment of the wedge facet 28 within the hole 14.

Figure 27:
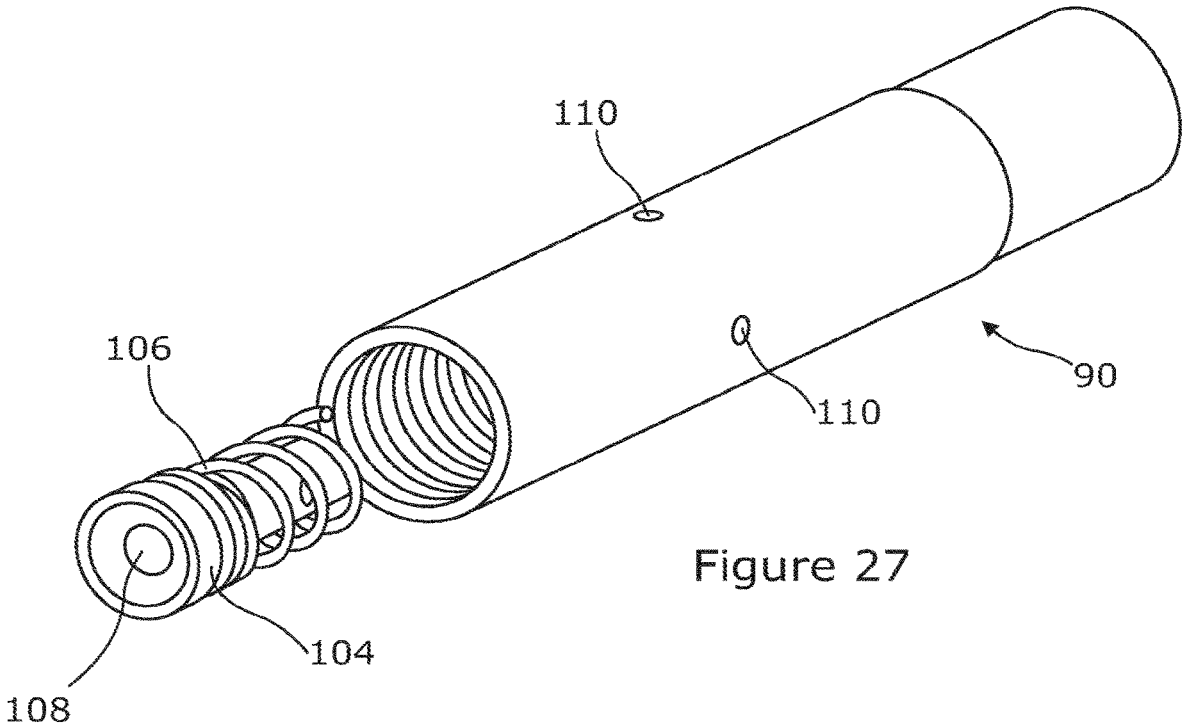
FIG. 27 is an enlarged exploded perspective view of a dump valve of the dropping mechanism.

The proximal end of the connecting tube 88 is in fluid communication with the dump valve 90 shown in isolation in FIG. 27. The dump valve 90 equalises the pressure of water inside and outside the drill string 12, normally allowing water from the drill string 12 to flow through and around the dropping mechanism 20 within the outer core barrel 22.

The dump valve 90 comprises a proximally-biased plunger 104 that can be forced distally against the bias of a spring 106. Water flowing distally down the drill string 12 flows through a central aperture 108 of the plunger 104.

When the plunger 104 is in its normal proximal position, some of the water that flows through its central aperture 108 exits through holes 110 in the surrounding tubular wall of the dump valve 90. However, increasing the pressure of water pumped into the drill string 12 at the surface overcomes the bias to move the plunger 104 distally. The plunger 104 then blocks the holes 110. This directs substantially all of the high pressure water flow into the connecting tube 88 and so bypasses the dump valve 90. The high-pressure water diverted by the dump valve 90 is directed via the connecting tube 88 into and along the wedge pipe 30 to activate the locking mechanism 24 of the wedge 18 as described above.

Figure 28:
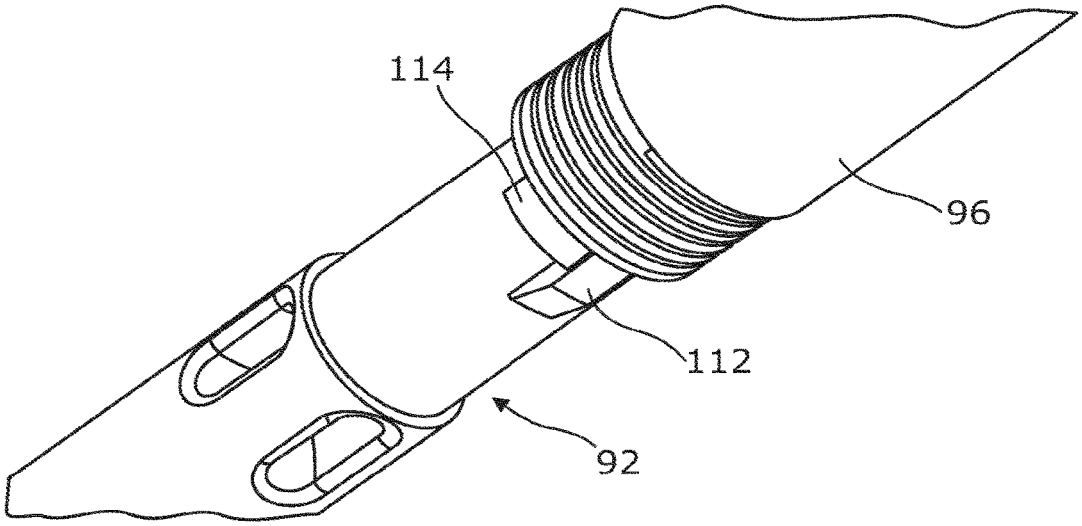
FIG. 28 is an enlarged perspective view of the interface between the outer core barrel and a latch mechanism of the dropping mechanism.

The latch mechanism 92 on the proximal end of the dump valve 90 is exemplified here by a Boart Longyear-type leaf-latch locking inner tube 92, shown enlarged in FIG. 28. The retriever guide system 94 is exemplified here by a specially-adapted Christensen-type quad latch 94, shown enlarged in FIG. 29. Both of these trade marks are used descriptively in the drilling industry for the respective products and so have become generic. Individually, both items of equipment are familiar to technicians in the industry and so need little further elaboration here.

Preferred embodiments of the invention use a Christensen-type quad latch 94 to replace a proximally-facing spear-point lifting coupling that characterises a Boart Longyear locking device 92. Thus, the use of a Christensen-type quad latch 94 in combination with a Boart Longyear locking device 92 is a novel and advantageous aspect of the invention. In accordance with the invention, therefore, familiar equipment that is compatible with existing drilling equipment may be used in a new and beneficial way.

A leaf-latch locking device 92 of the Boart Longyear-type comprises diametrically opposed retractable latch dogs 112, one of which is shown in FIG. 28. When the dropping mechanism 20 is lowered into engagement with the surrounding outer core barrel 22, the latch dogs 112 align longitudinally with an internal lug 114 within the sleeve 96 of the outer core barrel 22. Again, the lug 114 is shown in FIG. 28.

When the dropping mechanism 20 is seated within the outer core barrel 22, the latch dogs 112 protrude radially from the tube. As is conventional, this engages a shoulder within the outer core barrel 22 to lock the dropping mechanism 20 axially against proximal movement relative to the outer core barrel 22. The latch dogs 112 also engage the lug 114 to lock the dropping mechanism 20 angularly relative to the outer core barrel 22 and hence relative to the drill string 12 from which the outer core barrel 22 is suspended. Thus, torque applied at the surface to turn the drill string 12 also turns the dropping mechanism 20 and the wedge 18 suspended from the dropping mechanism 20 down the hole 14.

Figure 29:
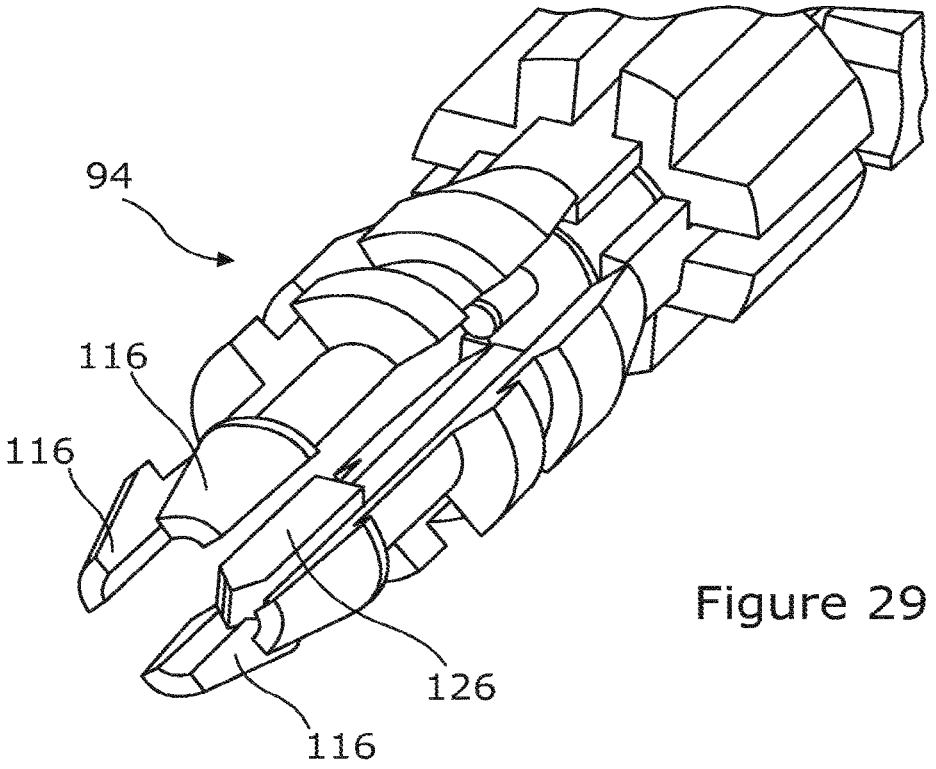
FIG. 29 is a perspective view of a quad latch retriever guide system of the dropping mechanism.

When the quad latch 94 shown in FIG. 29 is engaged by a wireline lifting system 42 as shown in FIG. 9 to retrieve the dropping mechanism 20 after setting the wedge 18, the lifting system 42 takes the weight of the dropping mechanism 20. This retracts the latch dogs 112 back into the tube to disengage them from the outer core barrel 22. The dropping mechanism 20 is now free to be lifted from within the outer core barrel 22 and to be retrieved to the surface. A standard inner core tube 44, which may for example be fitted with its own Boart Longyear leaf-latch locking device, may then be lowered into engagement with the outer core barrel 22 as shown in FIG. 11 so that wireline drilling can commence.

Christensen-type quad latches are disclosed, for example, in U.S. Pat. No. 4,482,013. Briefly, such a quad latch 94 is characterised by four proximally-extending sprung latches 116 that can be engaged by a corresponding wireline lifting system 42 to lift and retrieve an inner core tube from within an outer core barrel 22.

For the purposes of the invention, the quad latch 94 is fixed not to an inner core tube but instead to the remainder of the dropping mechanism 20 via the latch mechanism 92. Also, the quad latch 94 performs dual roles. Its first role is to enable the azimuthal orientation of the dropping mechanism 20, and hence of the wedge facet 28 of the wedge 18 attached to the dropping mechanism 20, to be surveyed before the wedge 18 is set. Its second role is to enable the dropping mechanism 20 to be retrieved to the surface using a wireline lifting system 42 after the wedge 18 has been set. This second role corresponds to its normal function of retrieving an inner core tube from within an outer core barrel 22, which is familiar to those skilled in the art and so needs no further elaboration here.

Figure 30:
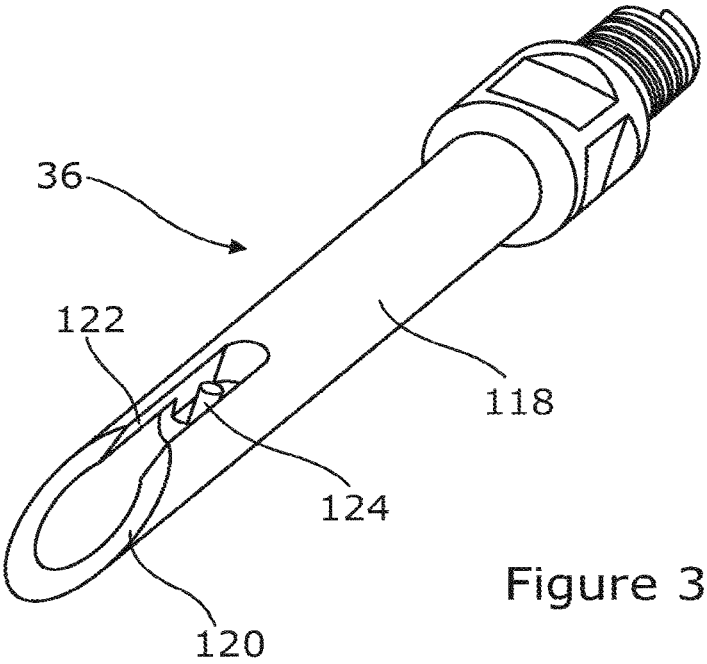
FIG. 30 is a perspective view of a surveying tool comprising a mule shoe that is engageable with the quad latch retriever guide system of FIG. 29.

To perform its first role of enabling surveying, the quad latch 94 of the invention is adapted to engage with the surveying tool 36 shown schematically in FIGS. 5 and 6 and enlarged in FIG. 30. The surveying tool 36 is also adapted to engage with the quad latch 94. For this purpose, the quad latch 94 and the surveying tool 36 are provided with complementary inter-engagement formations, as will be explained below.

The surveying tool 36 can be lowered within the drill string 12 on a wire extending from the surface to the quad latch 94, with which the surveying tool 36 then engages. For reliable determination of azimuth, it is necessary that the surveying tool 36 can only engage with the quad latch 94 at one angular position relative to the quad latch 94. Also, it is advantageous that the surveying tool 36 can turn automatically into that angular position during its engagement with the quad latch 94.

Specifically, a mule shoe 118 of the surveying tool 36 is arranged to project distally between the four proximally-extending latches 116 of the quad latch 94. The mule shoe 118 is a distally-extending tube that is cut across obliquely to form an inclined distal end face 120. A slot 122 extends proximally from a proximal side of the end face 120. An engagement sensor 124 is positioned in the slot 124.

Correspondingly, FIG. 29 shows that an inwardly-projecting, proximally-tapering key formation 126 is added to the inner side of one of the four latches 116 of the quad latch 94. The key formation 126 is shaped and oriented to fit into the slot 122 of the mule shoe 118 when the surveying tool 36 is aligned correctly with the quad latch 94. Thus, the key formation 126 adapts the quad latch 94 to provide a built-in orientation receiver.

Correct angular alignment of the surveying tool 36 with the quad latch 94 is assured by the inclined distal end face 120 of the mule shoe 118. The inclination of the distal end face 120 cooperates with the proximal taper of the key formation 126 to turn the surveying tool 36 about a longitudinal axis 32 as the mule shoe 118 moves distally. This rotation of the surveying tool 36 aligns the slot 122 with the key formation 126 as the mule shoe 118 slides distally around the key formation 126 and between the surrounding latches 116. The engagement sensor 124 then confirms engagement of the key formation 126 into the slot 124.

Optionally, a distally-facing camera within the surveying tool 36 can assist with angular alignment between the surveying tool 36 and the quad latch 94 and can confirm that the surveying tool 36 has been correctly engaged with the key formation 126 of the quad latch 94.

Where the parent hole 14 is inclined even slightly from the vertical—which it usually will be in practice, even in a nominally vertical hole—the surveying tool 36 can determine the azimuth of the wedge 18, and hence of the resulting daughter hole 46, gravitationally with reference to the high side and/or the low side of the hole 14. This is possible because the local inclination and azimuth of the parent hole 14 at the depth of the KOP is already known from a detailed survey of the hole 14 previously performed as a matter of routine.

The high side and/or the low side of the hole 14 can be determined by turning the drill string 12 to turn the dropping mechanism 20 about its longitudinal axis 32 within the hole 14. This also changes the orientation of the surveying tool 36 when engaged with the quad latch 94.

Knowing the high side and/or the low side of the hole 14 provides a reference or datum starting point for the use of grid reference or 'GR' positioning techniques. Advantageously, this avoids the need for non-magnetic drill rods, which are extremely expensive and typically cannot be used in a drill string as they are too soft.

In principle, however, it would be possible for the surveying tool 36 to determine azimuth in other ways, such as gyroscopically or magnetically with reference to magnetic north. Minor errors in dip and azimuth of the daughter hole 46 can be corrected during a subsequent motor drilling phase after initial wireline drilling past the wedge 18 has been completed.

Many variations are possible within the inventive concept. For example, the rigid link comprising the wedge pipe and the connecting tube does not necessarily have to be fractured or pulled proximally to be broken. Parts of the rigid link could be separated in other ways, for example by activating a disconnection mechanism or by twisting the wedge pipe beyond an angular limit or into a reverse thread.

What is claimed is:

1. A method of directional drilling, the method comprising:

advancing a wedge from a drilling rig to a kick-off point in a parent hole while supporting the wedge distally with respect to a tubular drill string via a longitudinally extending rigid link that extends along a central longitudinal axis through an annular cutting head to connect the wedge to the drill string;

locking the wedge at the kick-off point in the parent hole at a desired azimuth;

breaking the longitudinally extending rigid link to break the connection made by the longitudinally extending rigid link between the drill string and the locked wedge;

after breaking the connection, withdrawing at least part of the longitudinally extending rigid link through the cutting head and out of the parent hole; and without withdrawing the drill string, advancing the drill string to drill a daughter hole that branches from the parent hole on the azimuth determined by the wedge.

2. The method of claim 1, further comprising orienting the wedge to the desired azimuth by turning the drill string about the central longitudinal axis to apply torque to the wedge via the link.

3. The method of claim 1, further comprising fracturing the link to break the connection while leaving a distal portion of the link embedded in the wedge.

4. The method of claim 1, further comprising supporting the wedge via a dropping mechanism within the drill string.

5. The method of claim 4, further comprising retrieving the dropping mechanism to the drilling rig after breaking the connection.

6. The method of claim 5, further comprising engaging the dropping mechanism with a wireline lifting system advanced within the drill string.

7. The method of claim 4, further comprising replacing the dropping mechanism with an inner core tube that is advanced within the drill string before advancing the drill string to drill the daughter hole.

8. The method of claim 1, performed without disassembling the drill string.

9. The method of claim 1, further comprising conveying locking energy to the wedge via the link.

10. The method of claim 9, further comprising locking the wedge by applying fluid pressure through the link, and resisting locking of the wedge until a threshold fluid pressure is exceeded.

11. The method of claim 9, further comprising diverting drilling fluid through the link to lock the wedge, wherein the drilling fluid is diverted by applying over-threshold pressure to the fluid at the drilling rig.

12. The method of claim 11, further comprising conveying fluid through the link on a serpentine path to trap particles entrained in the fluid.

13. The method of claim 1, further comprising advancing a surveying tool within the drill string to determine the azimuth of the wedge before locking the wedge.

14. The method of claim 13, further comprising engaging the surveying tool with a dropping mechanism, wherein the dropping mechanism is rigidly connected to the wedge via the link.

15. The method of claim 14, further comprising engaging the surveying tool with a proximally-facing wireline retriever system of the dropping mechanism.

16. The method of claim 14, further comprising turning the surveying tool into alignment with the dropping mechanism in consequence of distal movement of the surveying tool relative to the dropping mechanism.

17. The method of claim 1, further comprising applying aligning force to the wedge to pivot the wedge about a pivot axis transverse to the central longitudinal axis, wherein the aligning force is applied while locking the wedge.

18. The method of claim 17, further comprising pivoting the wedge to force a proximal edge of the wedge against a surrounding wall of the parent hole.

19. The method of claim 1, further comprising pulling the drill string proximally to break the connection.

20. The method of claim 1, further comprising reaming a junction between the parent hole and the daughter hole by advancing the drill string.

21. The method of claim 1, wherein breaking the connection made by the link between the drill string and the locked wedge comprises breaking the longitudinally extending link at a line of weakness in the longitudinally extending link.

* * * * *